US012680549B1

(12) United States Patent
Hu et al.

(10) Patent No.: US 12,680,549 B1
(45) Date of Patent: Jul. 14, 2026

(54) PORTABLE FAN

(71) Applicant: SHENZHEN MAIYUE INTELLIGENT TECHNOLOGY CO., LTD, Shenzhen (CN)

(72) Inventors: Feng Hu, Shenzhen (CN); Guanghui Hu, Shenzhen (CN)

(73) Assignee: SHENZHEN MAIYUE INTELLIGENT TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/286,190

(22) Filed: Jul. 30, 2025

(30) Foreign Application Priority Data

Jan. 14, 2025 (CN) ..... 202520096390.0

(51) Int. Cl.
*F04D 25/06* (2006.01)
*B65H 75/44* (2006.01)
*B65H 75/48* (2006.01)

(52) U.S. Cl.
CPC ..... *F04D 25/0693* (2013.01); *B65H 75/4428* (2013.01); *B65H 75/486* (2013.01); *F04D 25/0673* (2013.01); *B65H 2701/34* (2013.01)

(58) Field of Classification Search
None
See application file for complete search history.

(56) References Cited

U.S. PATENT DOCUMENTS 1,434,609 A * 11/1922 Greensaft ..... F04D 25/086 416/69
5,304,035 A * 4/1994 Carter ..... F04D 25/084 362/108
6,106,235 A * 8/2000 Tettenborn ..... F04D 29/023 416/213 A (Continued)

FOREIGN PATENT DOCUMENTS

CN 204949817 U * 1/2016
CN 218070472 U * 12/2022

(Continued)

OTHER PUBLICATIONS

Translation of CN204949817 Zhang (Obtained from USPTO Search) (Year: 2025).*

(Continued)

*Primary Examiner* — Dominick L Plakkoottam
*Assistant Examiner* — Geoffrey S Lee
(74) *Attorney, Agent, or Firm* — Hemisphere Law, PLLC

(57) ABSTRACT

A portable fan includes a shell assembly, a fan, a power module and a retractable cable module. The shell assembly is provided with a cable outlet, the fan is arranged on the shell assembly, and the shell assembly is provided with an air outlet for air outgoing of the fan. The power module is arranged on the shell assembly and configured to supply power to the fan. The retractable cable module is arranged on the shell assembly and includes a cable body and a butt joint connected to one end of the cable body, and a width of the butt joint is not greater than a width of the cable outlet.

(Continued)

The cable body is capable of retracting into the cable outlet to be accommodated in the shell assembly, or extending out of the shell assembly to butt the butt joint to an external electronic device and supply power to the external electronic device through the power module.

14 Claims, 15 Drawing Sheets

(56) References Cited

U.S. PATENT DOCUMENTS 6,230,860 B1 * 5/2001 Wu ..... H02G 11/02 191/12.2 A
6,454,539 B1 * 9/2002 Santos ..... F04D 25/084 417/423.15
6,666,647 B1 * 12/2003 Trask ..... F04D 25/08 416/246
8,235,686 B2 * 8/2012 Wark ..... F24H 3/0417 416/63
9,479,212 B1 * 10/2016 Garcia ..... G06F 1/189
10,138,894 B1 * 11/2018 O'Connor ..... F04D 25/084
2003/0231958 A1 * 12/2003 Murray, Jr. ..... F04D 19/002 454/228
2005/0155830 A1 * 7/2005 Huang ..... H02G 11/02 191/12.2 R
2007/0190923 A1 * 8/2007 Gilley ..... F04D 25/08 454/208
2008/0101928 A1 * 5/2008 Chen ..... F04D 25/084 415/213.1
2008/0152482 A1 * 6/2008 Patel ..... F04D 25/084 415/121.3
2013/0052048 A1 * 2/2013 Santos ..... F04D 25/084 417/313
2014/0093404 A1 * 4/2014 Long ..... F04D 25/084 417/234
2016/0013675 A1 * 1/2016 Workman ..... H02J 7/0045 320/112
2016/0015113 A1 * 1/2016 Plain ..... F04D 25/084 2/171.3
2018/0266714 A1 * 9/2018 Perrelle ..... F04D 25/084
2018/0355875 A1 * 12/2018 Freeland ..... F04D 25/084
2019/0101126 A1 * 4/2019 Porter ..... F04D 25/0673
2020/0174537 A1 * 6/2020 Alford ..... H02G 1/00

FOREIGN PATENT DOCUMENTS

CN 221552379 U * 8/2024
WO WO-2017103802 A1 * 6/2017 ..... H02J 7/342

OTHER PUBLICATIONS

Translation CN221552379 Huang (Obtained from USPTO Search) (Year: 2025).*
Translation of CN-218070472 Rao (Obtained from USPTO Search) (Year: 2025).*
Definition of Worn (obtained from "https://www.google.com/search?q=define+worn" on Dec. 18, 2025) (Year: 2025).*

* cited by examiner

PORTABLE FAN

TECHNICAL FIELD

The present invention relates to the field of fan technologies, and in particular, to a portable fan.

BACKGROUND

Portable fans, such as neck fans, waist fans, and handheld fans, are generally convenient to carry and can dissipate heat for users in hot weather. Since the portable fan has relatively good portability and a good cooling performance, and with an improvement of a battery technology, an endurance performance of the portable fan is continuously improved, the portable fan is accepted by more and more users in outdoor, traveling, and other occasions. However, when using the portable fan, if needing to charge a mobile phone or other electronic devices, the user generally needs to use a mobile power source, which is inconvenient for the consumer.

SUMMARY

Embodiments of the present invention provide a portable fan, which improves use convenience of a user.

A portable fan includes:

a shell assembly provided with a cable outlet;

a fan arranged on the shell assembly, the shell assembly being provided with an air outlet for air outgoing of the fan;

a power module arranged on the shell assembly and configured to supply power to the fan; and a retractable cable module arranged on the shell assembly and including a cable body and a butt joint connected to one end of the cable body, a width of the butt joint being not larger than that of the cable outlet; the cable body being capable of retracting into the cable outlet to be accommodated in the shell assembly, or extending out of the shell assembly to butt the butt joint to an external electronic device and supply power to the external electronic device through the power module.

A portable fan includes:

a shell assembly including a first housing and a second housing connected to the first housing, the first housing and the second housing defining a cable outlet;

a fan arranged on the shell assembly, the shell assembly being provided with an air outlet for air outgoing of the fan;

a power module arranged on the shell assembly and configured to supply power to the fan; and a retractable cable module arranged on the shell assembly and including a cable body and a butt joint connected to one end of the cable body, a width of the butt joint being larger than that of the cable outlet; the cable body being capable of retracting into the cable outlet to be accommodated in the shell assembly, or extending out of the shell assembly to butt the butt joint to an external electronic device and supply power to the external electronic device through the power module.

BRIEF DESCRIPTION OF THE DRAWINGS

In order to illustrate the technical solutions in the embodiments of the present invention or the prior art more clearly, the drawings required for describing the embodiments or the prior art will be described briefly. Apparently, the following described drawings are merely for some embodiments of the present invention, and other drawings can be derived from these drawings by those of ordinary skill in the art without any creative effort.

DETAILED DESCRIPTION

Figure 1:
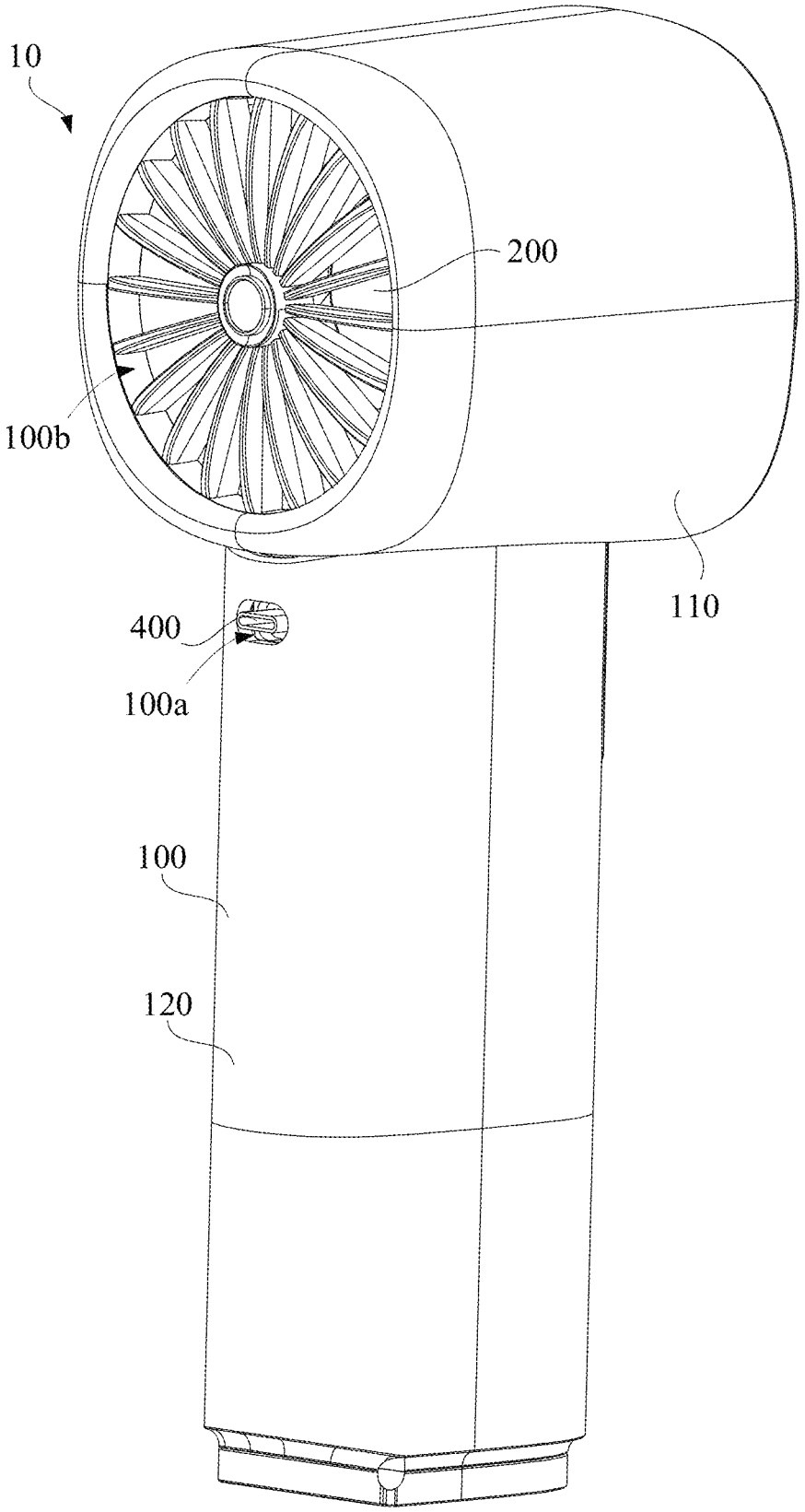
FIG. 1 is a schematic diagram of a portable fan according to a first embodiment.

To facilitate an understanding of the present invention, the present invention is described more fully hereinafter with reference to the accompanying drawings. Preferred embodiments of the present invention are shown in the drawings. However, the present invention may be implemented in many different forms and is not limited to the embodiments set forth herein. Rather, these embodiments are provided to make understanding of the disclosure of the present invention more thorough and complete.

It should be noted that when an element is referred to as being "fixed on" another element, the element may be directly located on the other element or an intermediate element may exist. When one element is considered to be "connected" to another element, it may be directly connected to the another element or an intermediate element may co-exist. The terms "vertical", "horizontal", "left", "right", and similar expressions used herein are for illustrative purposes only.

Unless defined otherwise, all technical and scientific terms used herein have the same meanings as would generally understood by those skilled in the technical field of the present invention. The terms used herein in the specification of the present invention are for the purpose of describing specific embodiments only, and are not intended to limit the present invention. The term "and/or" used herein includes any and all combinations of one or more related listed items.

First Embodiment

Figure 2:
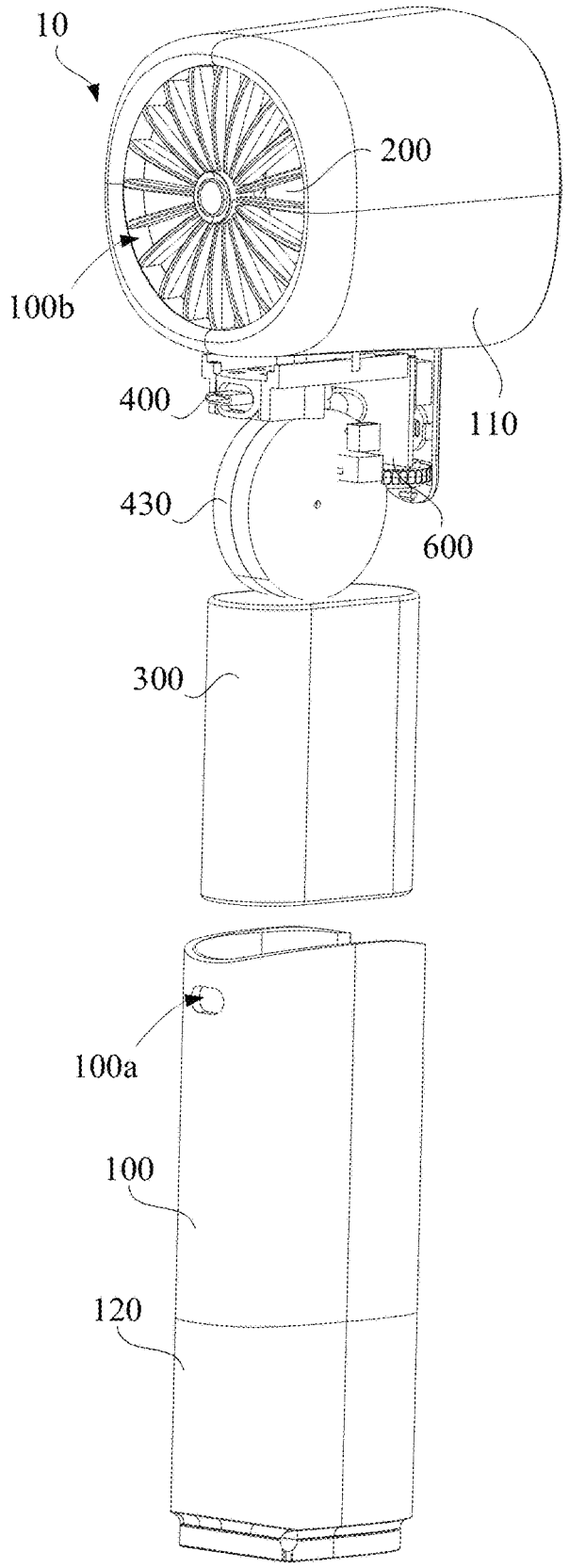
FIG. 2 is an exploded view of the portable fan shown in FIG. 1.
Figure 3:
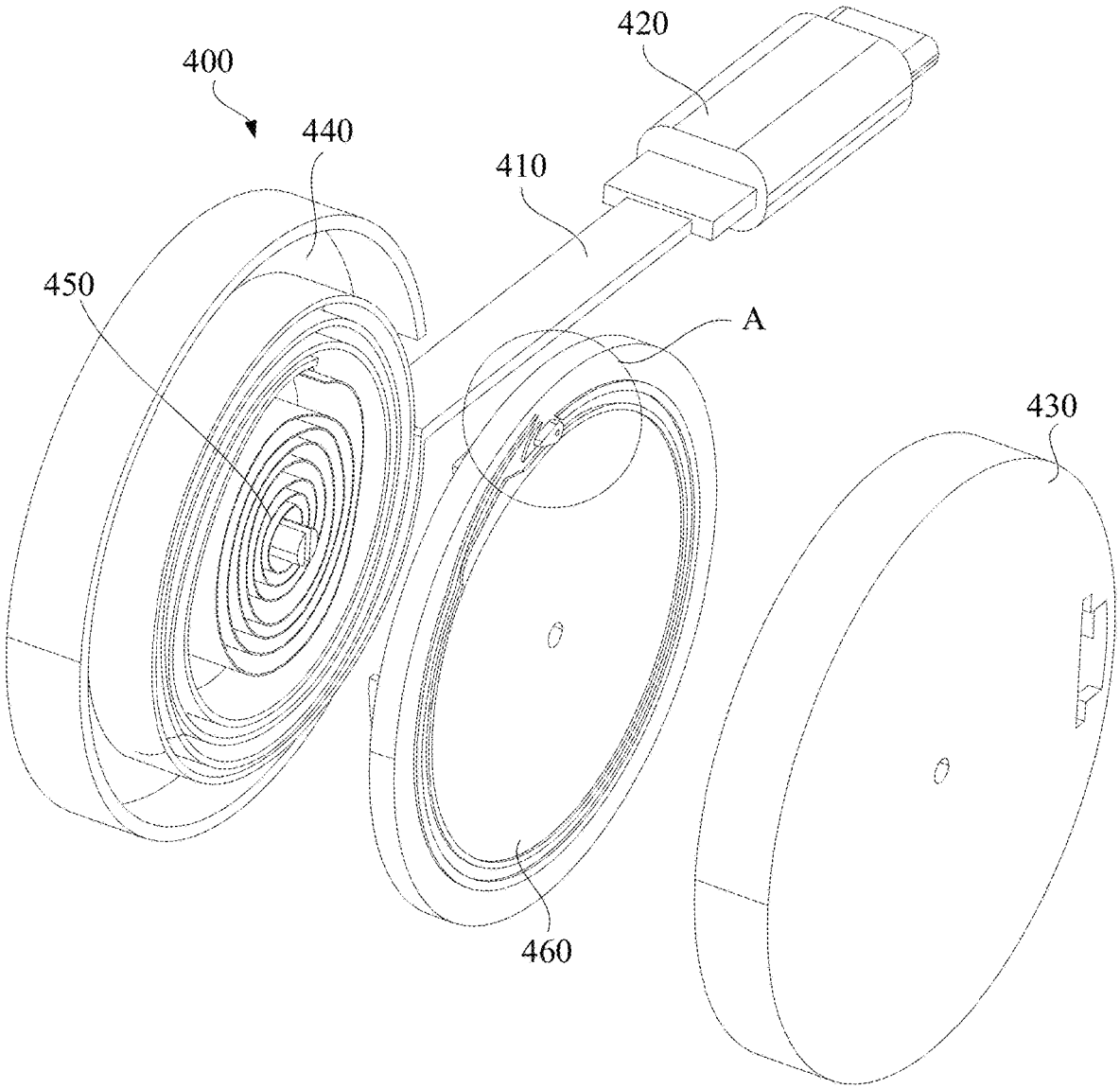
FIG. 3 is an exploded view of a retractable cable module of the portable fan according to an embodiment.
Figure 4:
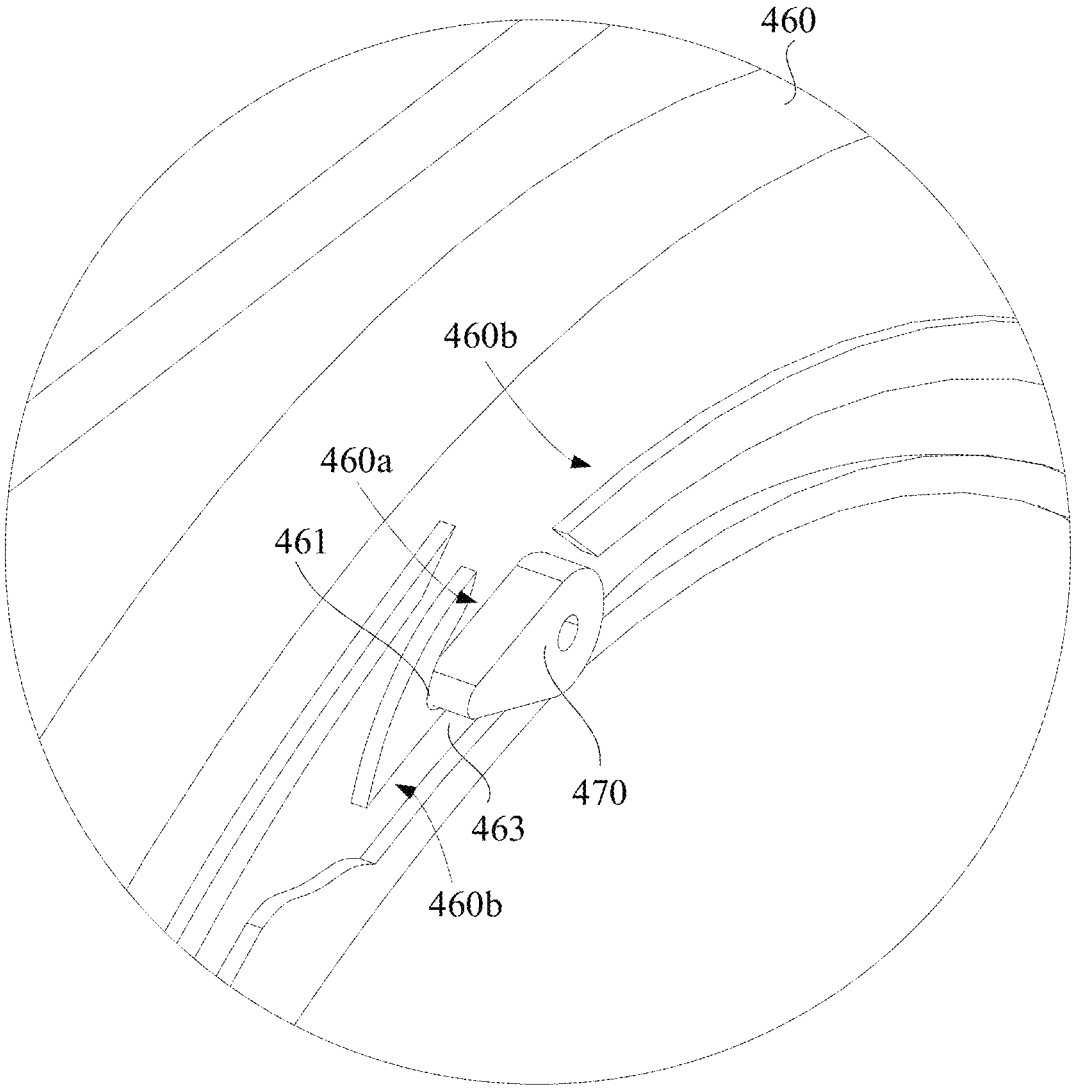
FIG. 4 is a schematic enlarged diagram at A of the retractable cable module shown in FIG. 3.

Referring to FIG. 1, FIG. 2 and FIG. 3 in conjunction with FIG. 4, a first embodiment of the present application discloses a portable fan 10, including a shell assembly 100, a fan 200, a power module 300 and a retractable cable module 400, wherein the shell assembly 100 is configured to provide support for the whole structure and is provided with a cable outlet 100*a* and an air outlet 100*b*. The fan 200 is arranged on the shell assembly 100 and blows air out from the air outlet 100*b*. In some implementations, the fan 200 is an axial fan. In some other implementations, the fan 200 may be a centrifugal fan. In other implementations, the fan 200 may be an air compressor, such as a charging turbine, so as to realize an impeller-free appearance design of the portable fan 10, that is, to achieve a bladeless fan 200 effect, such that an appearance of the portable fan 10 is simpler.

In some implementations, as shown in FIG. 1 and FIG. 2, the portable fan 10 is a handheld fan, the shell assembly 100 includes an air outlet portion 110 and a holding portion 120 connected to the air outlet portion 110, the air outlet portion 110 is provided with the air outlet 100*b*, the fan 200 is arranged on the air outlet portion 110, and the power module 300 and the retractable cable module 400 are arranged on the holding portion 120. One of the air outlet portion 110 and the holding portion 120 is provided with the cable outlet 100*a*. Certainly, in some other implementations, the fan 200 may be arranged on the holding portion 120, and the power module 300 and the retractable cable module 400 may also be arranged on the air outlet portion 110. A user can hold the holding portion 120 of the portable fan 10 and allow the air outlet 100*b* to face some parts of the body, such as the face or the neck, to blow air and dissipate heat.

Figure 5:
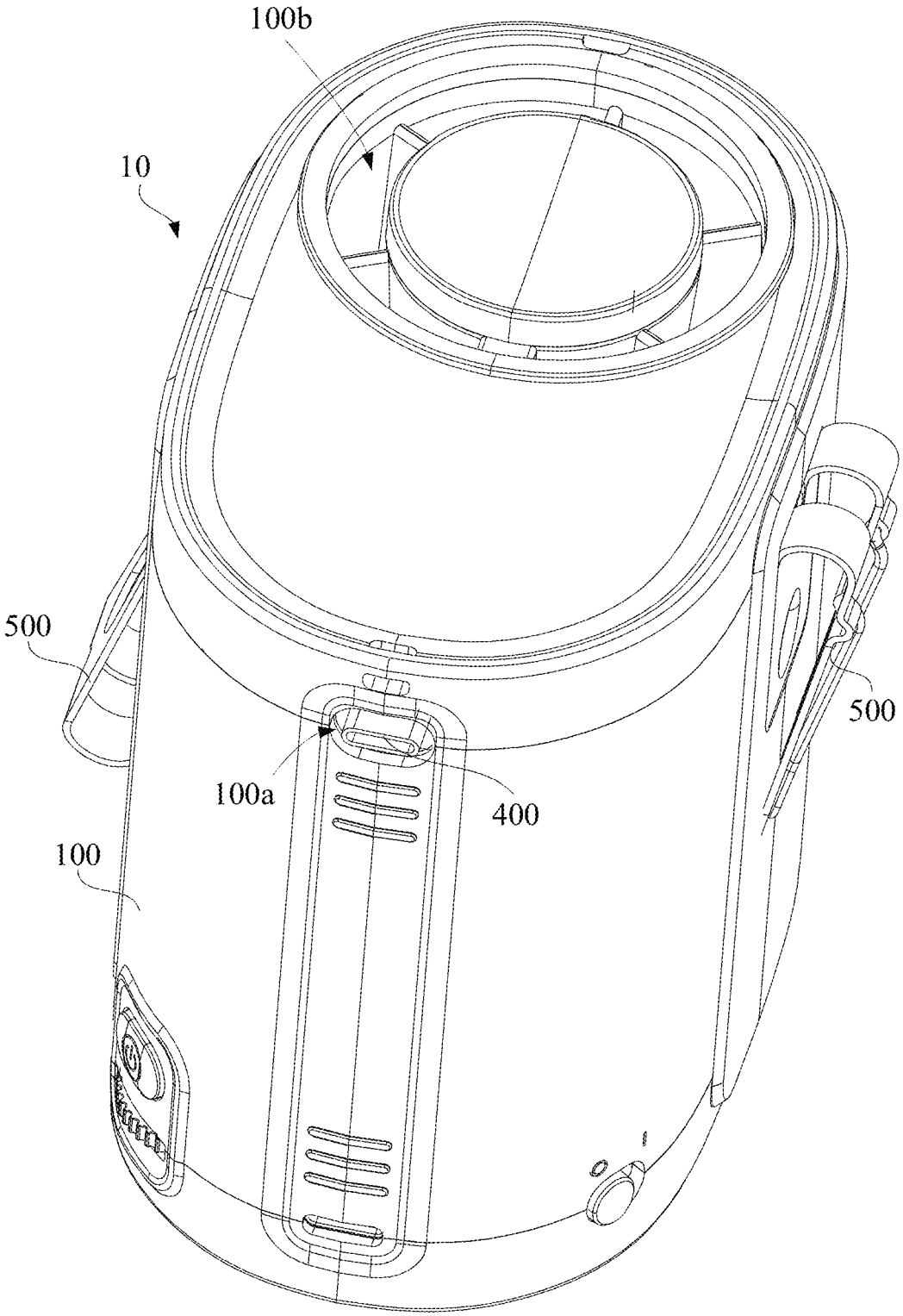
FIG. 5 is a schematic diagram of another portable fan according to the first embodiment.
Figure 6:
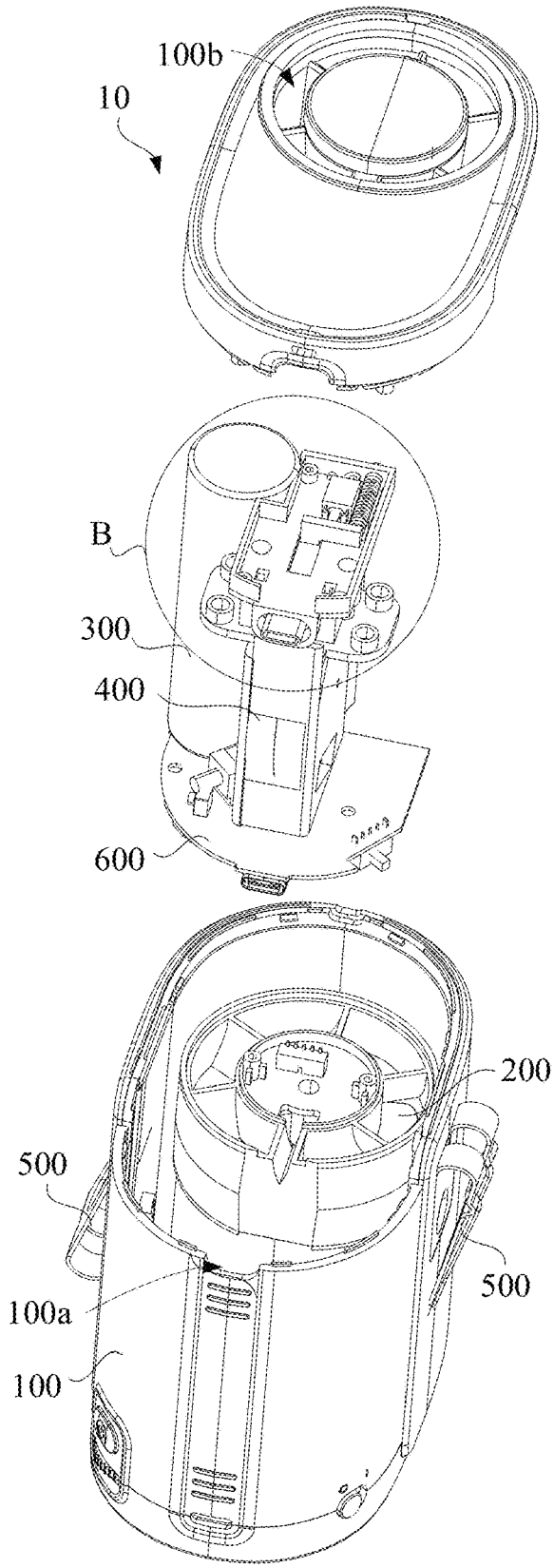
FIG. 6 is an exploded view of the portable fan shown in FIG. 5.

In some other implementations, referring to FIG. 5 and FIG. 6, the portable fan 10 may include a wearing portion 500 connected to the shell assembly 100, and the wearing portion 500 is configured to be worn to the body of the user. In some implementations, the wearing portion 500 is curved hardware having a free end that can be driven to be opened and closed relative to the shell assembly 100, and the portable fan 10 can be worn to a position, such as a waistband or a backpack strap, through the wearing portion 500. The portable fan 10 in this implementation is typically a waist fan, a clip fan, or the like.

Figure 7:
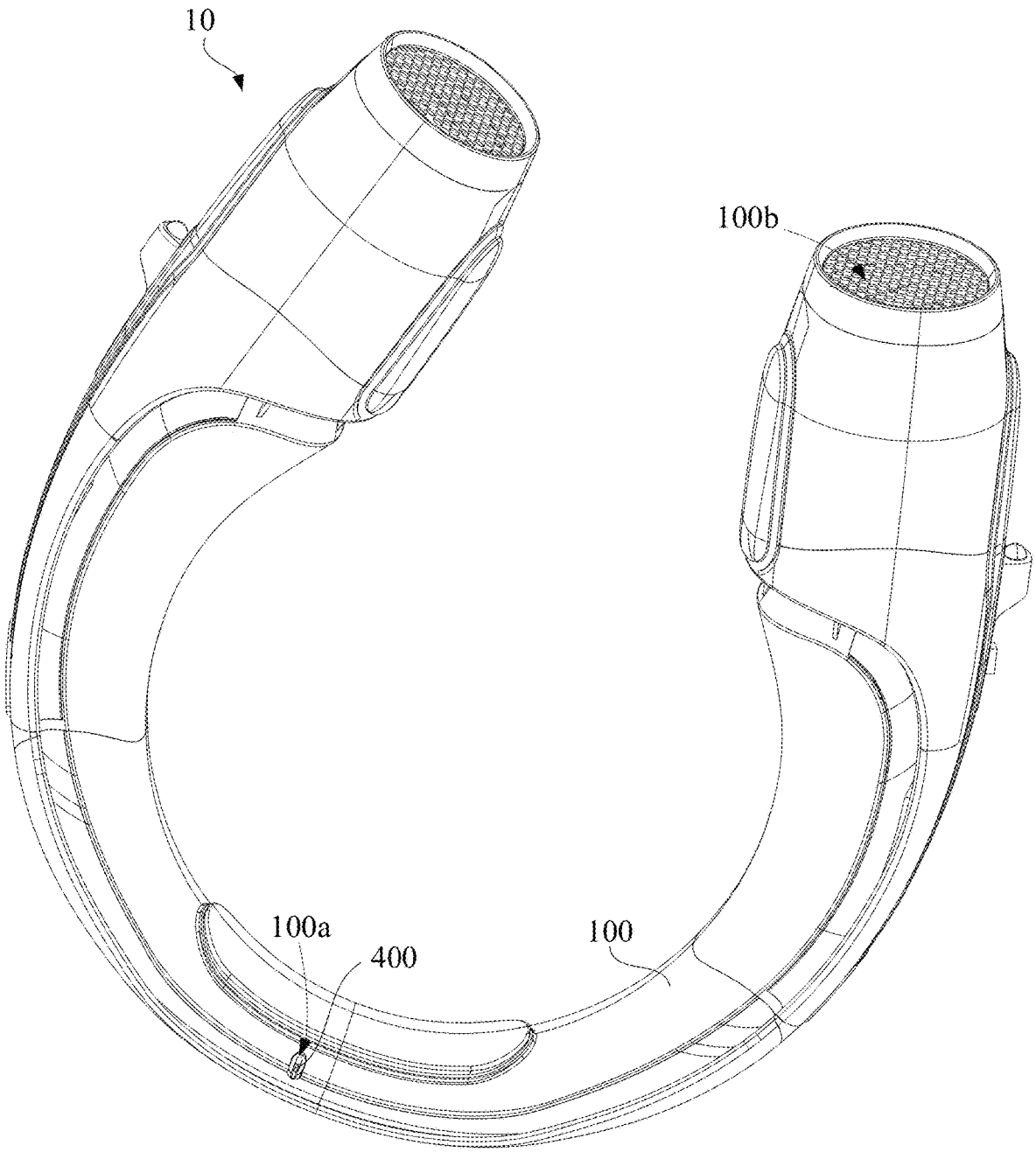
FIG. 7 is a schematic diagram of yet another portable fan according to the first embodiment.
Figure 8:
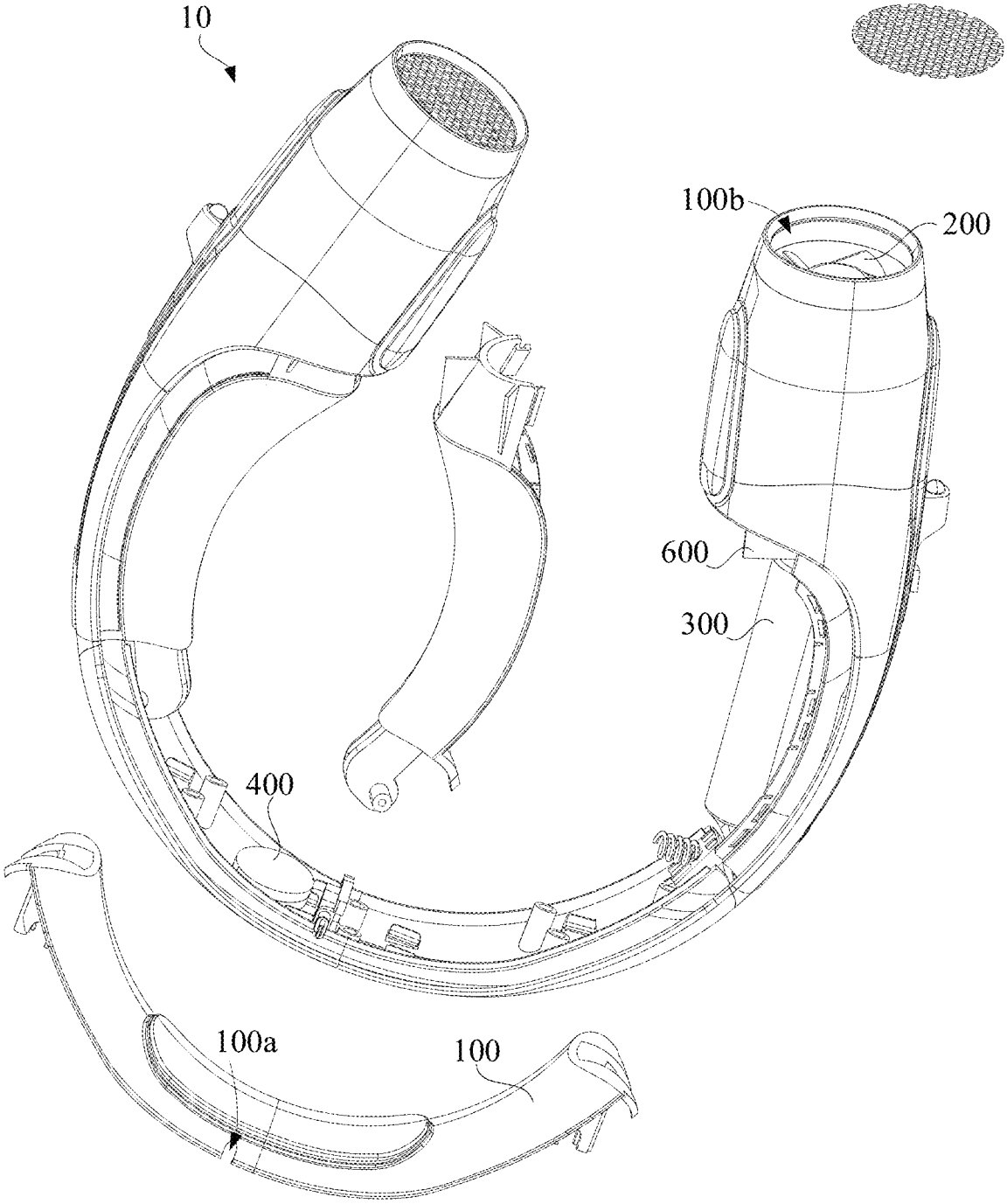
FIG. 8 is an exploded view of the portable fan shown in FIG. 7.

Referring to FIG. 7 and FIG. 8, in other implementations, the shell assembly 100 may also be provided with a space for being worn to the body of the user. For example, the shell assembly 100 is formed into an open ring shape, and the user may wear the portable fan 10 on the neck, and the portable fan 10 shown in FIG. 7 may also be referred to as a neck fan 200.

The present application is described by taking a handheld fan as an example, and adaptive variations may be made for other types of portable fans 10 which should not be excluded from the protection scope of the present application.

With continued reference to FIG. 2, the power module 300 is arranged on the shell assembly 100 and configured to supply power to the fan 200, the power module 300 of the portable fan 10 generally includes a rechargeable battery, such as a lithium battery, and as a battery technology advances, a capacity of the battery tends to continuously increase, and an endurance performance of the portable fan 10 is therefore steadily improved. Further, the portable fan 10 may include a circuit board 600 arranged in the shell assembly 100, the fan 200, the power module 300, and the retractable cable module 400 are electrically connected to the circuit board 600, and the circuit board 600 may integrate a control circuit, a power management unit, or the like, of the fan 200. The shell assembly 100 may further be provided with buttons, a rotating wheel, or the like, which are arranged corresponding to a trigger structure on the circuit board 600 and configured to control starting and stopping of the fan 200, or adjust a rotation speed of the fan 200. The buttons are not limited to physical buttons, and may be virtual buttons, such as virtual keys presented with a touch screen.

With simultaneous reference to FIG. 3, the retractable cable module 400 is arranged on the shell assembly 100 and includes a cable body 410 and a butt joint 420 connected to one end of the cable body 410, the cable body 410 is electrically connected to the circuit board 600, and a width of the butt joint 420 is not greater than a width of the cable outlet 100*a*. The cable body 410 is capable of retracting into the cable outlet 100*a* to be accommodated in the shell assembly 100, or extending out of the shell assembly 100 to butt the butt joint 420 to an external electronic device and supply power to the external electronic device through the power module 300. In some implementations, the cable body 410 may be accommodated in the shell assembly 100 in a wound mode to achieve a hiding effect of the cable body 410, such that the portable fan 10 maintains a simple appearance, and inconvenience of the user in normal use caused by the cable body 410 is avoided. When needing to supply power to the external electronic device, such as a mobile phone, the user may pull the cable body 410 of the retractable cable module 400 out of the shell assembly 100 and butt the cable body 410 to the external electronic device through the butt joint 420, so as to supply power to the external electronic device, for example, charge the mobile phone, through the power module 300 of the portable fan 10. The butt joint 420 is not limited to a Type-C interface, a Micro-USB interface, a Lightning interface, a magnetic charging interface, or the like, and is not repeated herein.

In the implementation of the present application, the width of the butt joint 420 is not greater than the width of the cable outlet 100*a*, which can be understood to mean that a cross-sectional area of the butt joint 420 is not greater than a cross-sectional area of the cable outlet 100*a*, such that the butt joint 420 can extend out of the shell assembly 100 through the cable outlet 100*a* in an assembly process, and after the retractable cable module 400 is assembled to the shell assembly 100, the butt joint 420 extends out of the shell assembly 100, thereby ensuring assembly smoothness of the retractable cable module and the shell assembly 100. It may be understood that the width of the cable outlet 100*a* is equal to or slightly larger than the width of the butt joint 420, or the cross-sectional area of the cable outlet 100*a* is equal to or slightly larger than the cross-sectional area of the butt joint 420, so as to prevent large damage to appearance integrity of the shell assembly 100 caused by formation of an oversized cable outlet 100*a* in the shell assembly 100.

Referring to FIG. 3, the retractable cable module 400 may include a casing 430 arranged in the shell assembly 100 (e.g., the holding portion 120), positions of the casing 430 and the power module 300 are fixed relatively, and the cable body 410 is telescopically arranged in the casing 430. The casing 430 may be fixedly connected to the circuit board 600 or fixedly connected to the shell assembly 100, so as to relatively fix the positions of the casing 430 and the circuit board 600. The retractable cable module 400 including the casing 430 may be manufactured as an independent module and assembled into the shell assembly 100, thereby improving an assembly efficiency and ensuring working reliability of the retractable cable module 400.

The retractable cable module 400 may include a circuit board 440, a torsion spring 450, and a turntable 460 arranged in the casing 430, and positions of the circuit board 440 and the casing 430 are relatively fixed. For example, the circuit board 440 is fixedly connected to the casing 430 or the shell assembly 100, and the circuit board 440 is electrically connected with the circuit board 600, for example, by lead bonding. The torsion spring 450 may be helical and have one end with a position fixed relative to the position of the casing 430 and the other end with a position fixed relative to a position of the turntable 460. The turntable 460 is rotatably connected with the casing 430. For example, one of the turntable 460 and the casing 430 is provided with a rotating shaft, and the other is provided with a shaft hole fitted with the rotating shaft. The cable body 410 is wound around the torsion spring 450, one of the circuit board 440 and the turntable 460 is provided with a contact pin (not shown), the other is provided with an annular conductor (not shown), the contact pin is in contact with the annular conductor for conduction, and the cable body 410 is electrically connected with the contact pin or the annular conductor on the turntable 460, such that an electrical connection between the cable body 410 and the circuit board 440 is realized. For example, the circuit board 440 is provided with the contact pin, the turntable 460 is provided with the annular conductor, and the cable body 410 is electrically connected with the annular conductor; or the circuit board 440 is provided with the annular conductor, the turntable 460 is provided with the contact pin, and the cable body 410 is electrically connected with the contact pin, such that the electrical connection between the cable body 410 and the circuit board 440 is realized. Certainly, the cable body 410 may be directly electrically connected with the circuit board 440 by lead bonding, or the like.

The cable body 410 may be clamped on the turntable 460, and in the process that the user pulls the cable body 410, the cable body 410 drives the turntable 460 to rotate relative to the casing 430 along one direction, for example, clockwise direction, so as to gradually extend out of the casing 430, and in this process, the contact pin keeps contact with the annular conductor, thereby ensuring the electrical connection between the cable body 410 and the circuit board 600. In this process, the torsion spring 450 accumulates elastic potential energy, such that the turntable 460 tends to rotate counterclockwise. When the user no longer needs to supply power to the external electronic device through the portable fan 10, the torsion spring 450 may release the elastic potential energy to drive the cable body 410 extending out of the casing 430 to be gradually wound into the casing 430.

In simultaneous conjunction with FIG. 4, in some implementations, the retractable cable module 400 includes a limiting member 470 rotatably connected to the casing 430, the turntable 460 has a locking position 461 and an unlocking position 463, and when the cable body 410 is pulled out of the casing 430, the cable body 410 drives the turntable 460 to rotate until the locking position 461 corresponds to the limiting member 470, and the limiting member 470 limits rotation of the turntable 460; when the cable body 410 continues to be pulled out of the casing 430 and drives the turntable 460 to rotate, the limiting member 470 rotates relative to the casing 430 and moves to the unlocking position 463, such that the cable body 410 can be gradually wound into the casing 430. FIG. 4 shows that the turntable 460 is provided with a limiting groove 460*a* and a guide groove 460*b* corresponding to each other, a groove wall of the limiting groove 460*a* can be used as the locking position 461, and a junction between a groove wall of the guide groove 460*b* and the groove wall of the limiting groove 460*a* is the unlocking position 463.

A side wall of the guide groove 460*b* can guide and limit movement of a tail end of the limiting member 470, such that in the process of pulling out the cable body 410, the tail end of the limiting member 470 continuously moves along the guide groove 460*b*, and when the user no longer pulls the cable body 410 to extend out, the torsion spring 450 drives the turntable 460 to rotate in an opposite direction (for example, clockwise), the tail end of the limiting member 470 is guided by the side wall of the guide groove 460*b* to enter the limiting groove 460*a*, and then, the cable body 410 is locked; when the user continues to pull the cable body 410 to extend out, the turntable 460 continues to rotate in the original direction (e.g., counterclockwise), the tail end of the limiting member 470 exits the limiting groove 460*a* and enters the guide groove 460*b*, and the cable body 410 may continue to be pulled outwards. It can be understood that the above functions can be achieved by designing depths and widths of the guide groove 460*b* and the limiting groove 460*a*, which is not repeated herein.

When the user pulls the cable body 410 to extend out of the casing 430 and drive the turntable 460 to rotate, a locking point of the tail end of the limiting member 470 moves to the locking position 461 along the guide groove 460*b*, and at this point, if the user does not pull the cable body 410 any more, the locking point of the tail end of the limiting member 470 abuts against the groove wall of the limiting groove 460*a* under the action of the torsion spring 450, and the turntable 460 does not rotate any more, such that a locking effect of the cable body 410 can be achieved; when the user continuously pulls the cable body 410 out of the casing 430 to drive the turnable 460 to rotate, the limiting member 470 rotates relative to the casing 430, retracts to the guide groove 460*b*, and can switch to the guide groove 460*b* to continue to move along the guide groove 460*b*, that is, to the unlocking position 463, the turntable 460 can continuously rotate and make the cable body 410 continuously extend out of the casing 430, or the cable body 410 can be gradually wounded into the casing 430. The limiting member 470 and the turntable 460 are fitted to achieve effects of locking and automatic winding of the cable body 410, thus improving use convenience. Moreover, the turntable 460 may have two or more locking positions 461 and two or more unlocking positions 463, and the locking positions 461 and the unlocking positions 463 may be in one-to-one correspondence.

Certainly, in some other implementations, other structures may be adopted to replace locking of the cable body 410 by the limiting member 470. For example, the limiting member 470 has a first state and a second state, and in the first state, the cable body 410 can be pulled out of or retracted into the shell assembly 100; in the second state, the limiting member 470 abuts against the cable body 410 and limits movement of the cable body 410 relative to the shell assembly 100.

Exemplarily, the limiting member 470 is in sliding fit with the shell assembly 100, and the limiting member 470 and the shell assembly 100 slide with a suitable damping, so as to prevent the limiting member 470 from easily retracting. In the process that the user pulls out the cable body 410, when the cable body 410 needs to be locked, the limiting member 470 is pushed to slide relative to the shell assembly 100 to a position where the limiting member 470 abuts against the cable body 410, i.e., the second state, and the locking of the cable body 410 on the shell assembly 100 can be realized; when the user needs to retract the cable body 410 into the shell assembly 100, the limiting member 470 is pushed in an opposite direction to the first state, and after the limiting member 470 no longer abuts against the cable body 410, the cable body 410 can be rewound into the casing 430 under the action of the torsion spring 450 and the turntable 460.

Exemplarily, the limiting member 470 is in rotation fit with the shell assembly 100, and the limiting member 470 may have an eccentric wheel structure and have a suitable rotational damping to prevent the limiting member 470 from easily retracting. In the process that the user pulls out the cable body 410, when the cable body 410 needs to be locked, the limiting member 470 is rotated to cause an eccentric wheel of the limiting member 470 to abut against the cable body 410, that is, the second state is realized, and the locking of the cable body 410 on the shell assembly 100 can be realized; when the user needs to retract the cable body 410 into the shell assembly 100, the limiting member 470 is rotated in the opposite direction to the first state, and after the eccentric wheel of the limiting member 470 no longer abuts against the cable body 410, the cable body 410 can be rewound into the casing 430 under the action of the torsion spring 450 and the turntable 460.

The structures of both the above two limiting members 470 can realize the locking of the cable body 410, and the automatic winding effect can be achieved in conjunction with the torsion spring 450, thus improving the use convenience. In other implementations, the limiting member 470 may have other structural forms as long as the effect of locking the cable body 410 is achieved.

It may be understood that the casing 430 of the retractable cable module 400 is not essential and may be absent to simplify the structure of the portable fan 10 and to enhance structural compactness of the portable fan 10. For example, the retractable cable module 400 includes a torsion spring 450 and a turntable 460 rotatably connected to the shell assembly 100 or the circuit board 600, one free end of the torsion spring 450 is connected to the turntable 460, a position of the other free end of the torsion spring 450 is fixed relative to the position of the circuit board 600, and the cable body 410 is wound around the torsion spring 450 and directly and electrically connected with the circuit board 600, for example, by soldering or in conjunction with lead bonding, or the cable body 410 is electrically connected with the circuit board 600 through a contact pin and an annular conductor. The cable body 410 can be clamped on the turntable 460, and in the process that the user pulls the cable body 410, the cable body 410 drives the turntable 460 to rotate relative to the shell assembly 100 along one direction, for example, clockwise direction, so as to gradually extend out of the shell assembly 100, and in this process, the torsion spring 450 accumulates elastic potential energy, such that the turntable 460 tends to rotate counterclockwise. When the user no longer needs to supply power to the external electronic device through the portable fan 10, the torsion spring 450 releases the elastic potential energy to drive the cable body 410 extending out of the shell assembly 100 to be gradually wound into the shell assembly 100.

In this implementation, the retractable cable module 400 may also include a limiting member 470, the turntable 460 has a locking position 461 and an unlocking position 463, and when the cable body 410 is pulled out of the shell assembly 100, the cable body 410 drives the turntable 460 to rotate until the locking position 461 corresponds to the limiting member 470, and the limiting member 470 limits rotation of the turntable 460; when the cable body 410 continues to be pulled out of the shell assembly 100 and drives the turntable 460 to rotate, the limiting member 470 moves to the unlocking position 463 relative to the turntable 460, such that the cable body 410 is gradually wound into the shell assembly 100, and reference may be made to the foregoing content for the principles and structures for locking and unlocking the cable body 410 by the limiting member 470 which are not repeated herein. The limiting member 470 and the turntable 460 are fitted to realize the locking of the cable body 410, and the automatic winding effect can be achieved in conjunction with the torsion spring 450, thus improving the use convenience.

Certainly, in this implementation, the limiting member 470 may also have a first state and a second state, and in the first state, the cable body 410 can be pulled out of or retracted into the shell assembly 100; in the second state, the limiting member 470 abuts against the cable body 410 and limits movement of the cable body 410 relative to the shell assembly 100. Reference may also be made to the foregoing content for the principles and structures for locking and unlocking the cable body 410 by the limiting member 470 which are not repeated herein. The structure of the limiting member 470 can realize the locking of the cable body 410, and the automatic winding effect can be achieved in conjunction with the torsion spring 450, thus improving the use convenience. In other implementations, the limiting member 470 may have other structural forms as long as the effect of locking the cable body 410 is achieved.

Figure 9:
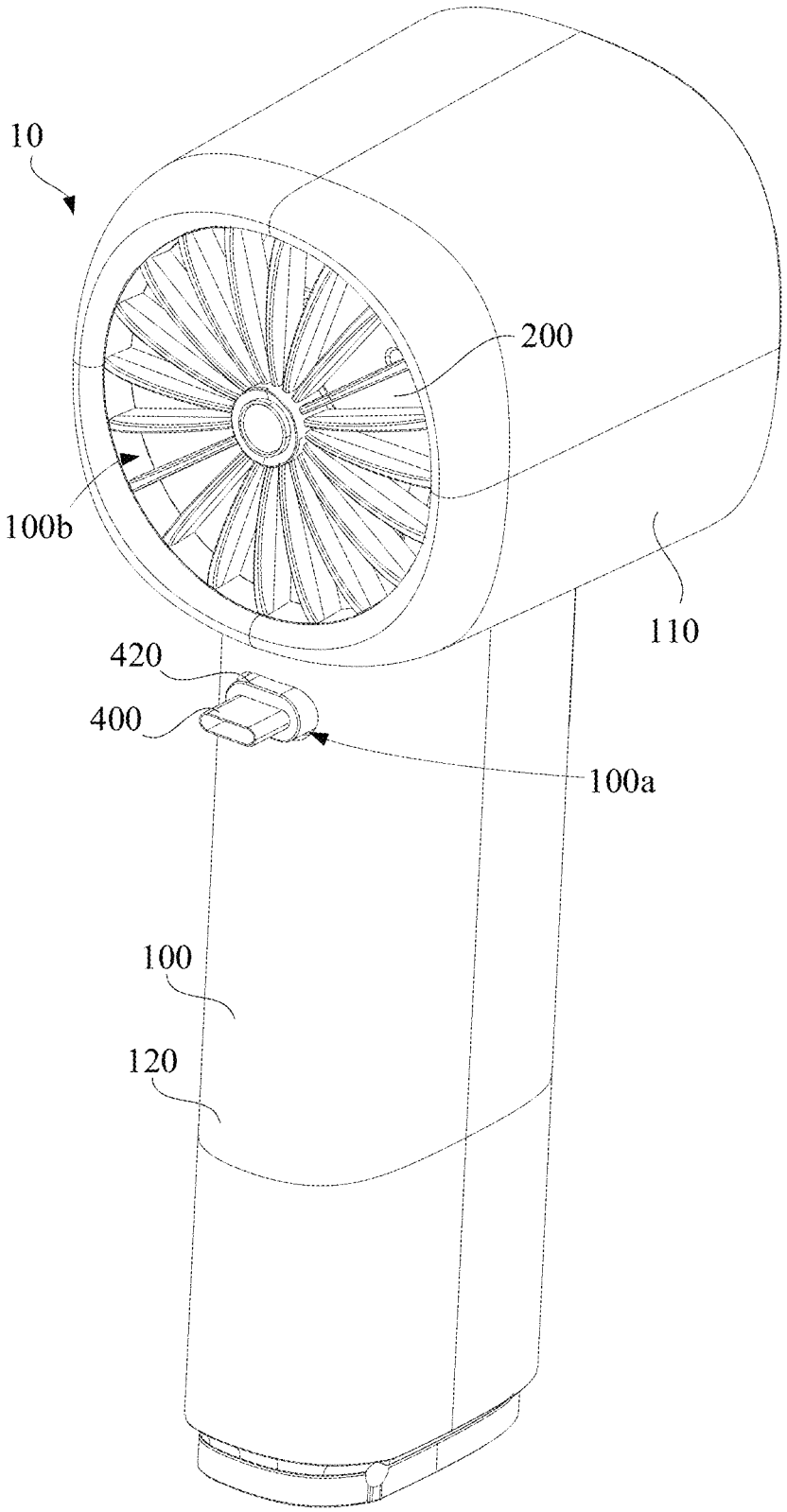
FIG. 9 is a schematic diagram of an implementation of the portable fan according to the first embodiment.

Referring to FIG. 9, in some implementations, the butt joint 420 has a first position and a second position relative to the shell assembly 100, and in the first position, the cable body 410 is accommodated in the shell assembly 100 and the butt joint 420 is at least partially accommodated in the cable outlet 100*a*. In the second position, the cable body 410 and the butt joint 420 extend out of the shell assembly 100 for butting to the external electronic device. In other words, in the first position, the butt joint 420 may partially protrude from the cable outlet 100*a*, so as to avoid that the butt joint 420 excessively extends out of the shell assembly 100 to cause use inconvenience, and meanwhile, the user may conveniently pinch the butt joint 420 with fingers to pull the butt joint 420 and the cable body 410 out of the shell assembly 100. Certainly, in the first position, the butt joint 420 may be entirely accommodated in the cable outlet 100*a*.

Figure 10:
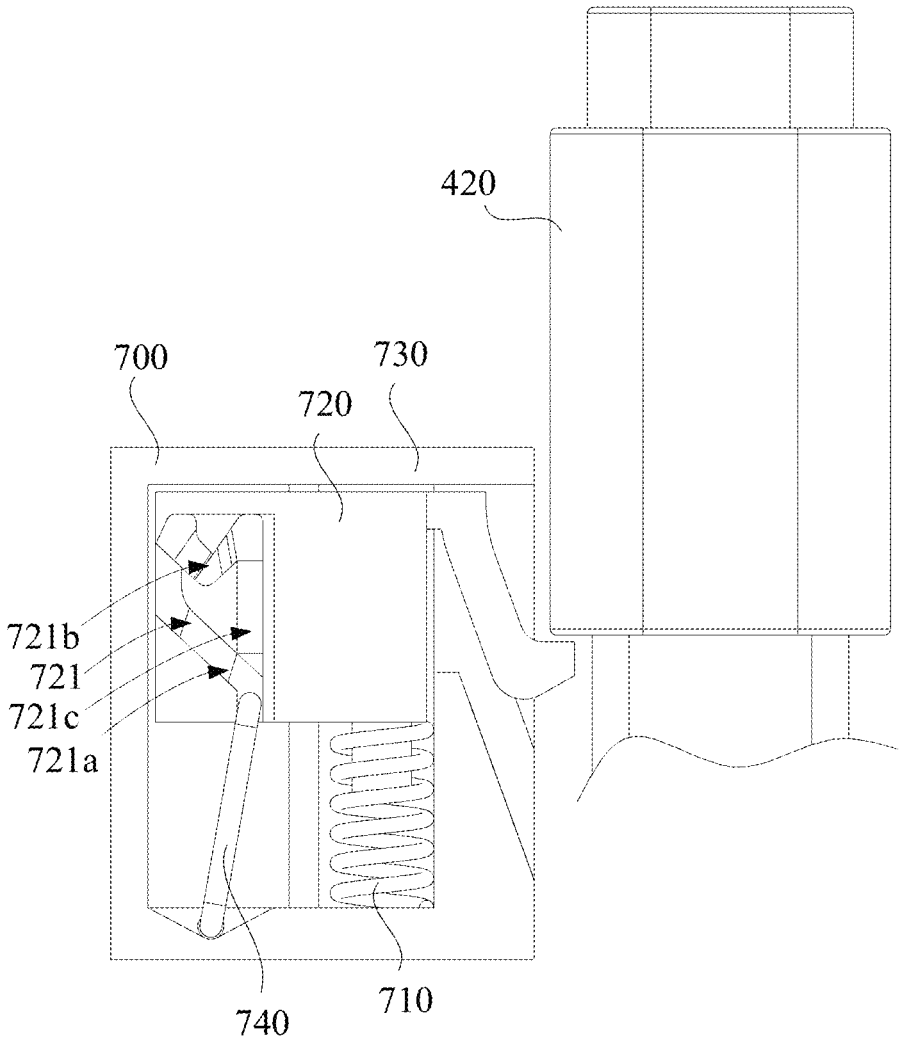
FIG. 10 is a schematic diagram of a fitted state of an ejecting assembly and a butt joint in the first embodiment.
Figure 11:
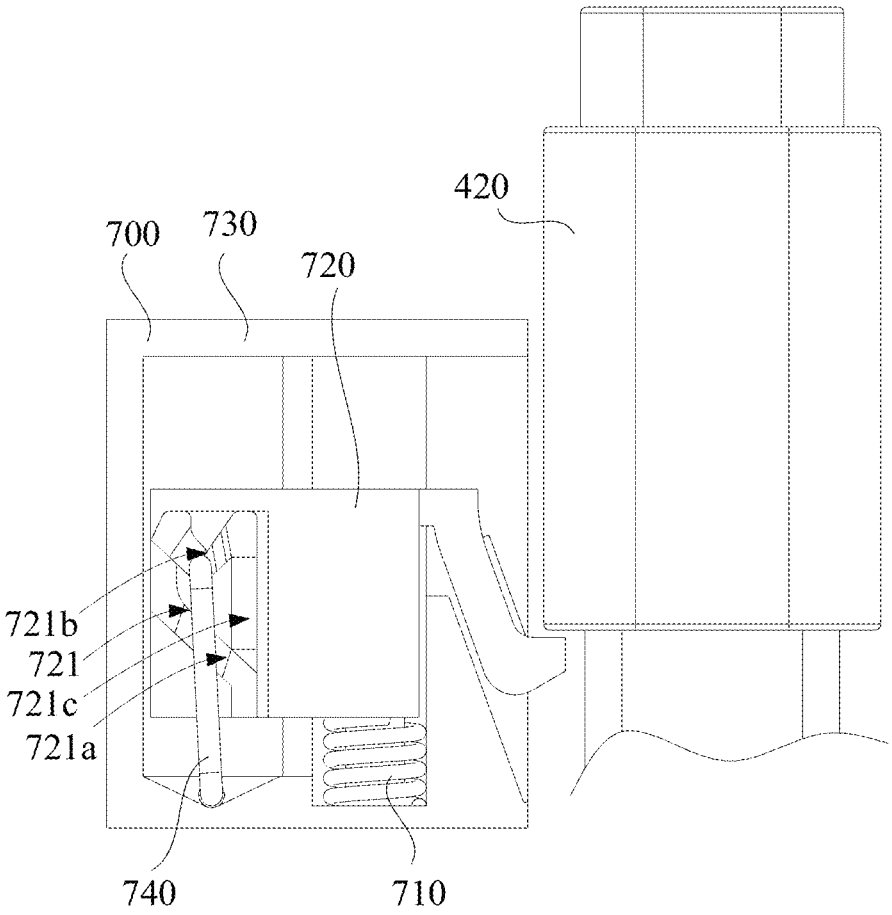
FIG. 11 is a schematic diagram of another fitted state of the ejecting assembly and the butt joint shown in FIG. 10.

In conjunction with FIG. 10 and FIG. 11, in this implementation, the portable fan 10 may include an ejecting assembly 700 arranged on the shell assembly 100, and the ejecting assembly 700 is configured to be triggered to eject the butt joint 420 in the first position out of the shell assembly 100 through the cable outlet 100*a*. Specifically, the ejecting assembly 700 may include an elastic member 710 arranged in the shell assembly 100 and a slider 720 connected to the elastic member 710, and in the process that the butt joint 420 is switched from the second position to the first position, the slider 720 is driven by the butt joint 420 to move inside the shell assembly 100 and locked in the first position, and the elastic member 710 accumulates elastic potential energy, as shown in FIG. 11. The slider 720 is configured to be triggered to be unlocked from the shell assembly 100, and the elastic member 710 drives the slider 720 to drive the butt joint 420 to be ejected out of the shell assembly 100, as shown in FIG. 10.

Specifically, referring to FIG. 10 and FIG. 11, in some implementations, the ejecting assembly 700 includes a mounting base 730 connected to the shell assembly 100 and a pull rod 740 having one end rotatably connected to the mounting base 730, the slider 720 is in sliding fit to the mounting base 730, the elastic member 710 has one end connected to the mounting base 730 and the other end connected to the slider 720, and the other end of the pull rod 740 is in sliding fit to the slider 720. In the process that the butt joint 420 is pressed into the cable outlet 100*a* and moves to the first position, the butt joint 420 drives the slider 720 to move relative to the mounting base 730 to clamp the pull rod 740 to the slider 720 at the first position; when the pull rod 740 is clamped to the slider 720, the butt joint 420 is pushed inwards along the cable outlet 100*a*, the pull rod 740 can be unlocked from the slider 720, and the elastic member 710 can push the butt joint 420 to be ejected from the cable outlet 100*a* through the slider 720.

Specifically, the slider 720 may be provided with a sliding groove 721, the sliding groove 721 includes an entering groove 721*a*, a clamping groove 721*b* and an exiting groove 721*c*, the clamping groove 721*b* is communicated with the entering groove 721*a* and the exiting groove 721*c*, and the exiting groove 721*c* is communicated with the entering groove 721*a*. A bottom wall of the entering groove 721*a* is provided with a plurality of steps, such that a depth of the entering groove 721*a* is increased from an entrance of the entering groove 721*a* to a position of the clamping groove 721*b*. A depth of the exiting groove 721*c* is smaller than a depth of the clamping groove 721*b*, a bottom wall of the exiting groove 721*c* is in smooth transition with a bottom wall of the clamping groove 721*b*, and a depth of an exit of the exiting groove 721*c* is smaller than a depth of the entrance of the entering groove 721*a*, so as to prevent a free end of the pull rod 740 from being erroneously pushed into the exiting groove 721*c* at the entrance of the entering groove 721*a*. The butt joint 420 is pushed inwards along the cable outlet 100*a*, the free end of the pull rod 740 slides into the entering groove 721*a* from the entrance of the entering groove 721*a*, and slides along an extending direction of the entering groove 721*a* into the clamping groove 721*b*, and the pull rod 740 is clamped to the slider 720 in the clamping groove 721*b*, such that the slider 720 is locked on the mounting base 730, and the butt joint 420 reaches the first position. When the pull rod 740 is clamped to the slider 720, the butt joint 420 is pushed inwards along the cable outlet 100*a*, the pull rod 740 slides into the exiting groove 721*c* and slides along an extending direction of the exiting groove 721*c* towards the entrance of the entering groove 721*a*, and the elastic member 710 pushes the butt joint 420 to be ejected from the cable outlet 100*a* through the slider 720.

For the ejecting assembly 700, in the process that the cable body 410 is accommodated into the shell assembly 100, the user pushes the butt joint 420 into the cable outlet 100*a*, and a step structure formed by a height difference between the butt joint 420 and the cable body 410 can push the slider 720 to move, such that the free end of the pull rod 740 moves in the sliding groove 721 and is clamped to the clamping groove 721 *b*; when the free end of the pull rod 740 is clamped to the clamping groove 721*b*, the butt joint 420 reaches the first position, the slider 720 is locked in the shell assembly 100, and the user can conveniently put the portable fan 10 into a bag or a pocket, thereby avoiding that the butt joint 420 is directly suspended outside the shell assembly 100 to adversely affect the use convenience. With this structural arrangement, the shell assembly 100 also protects the butt joint 420 when the butt joint 420 is in the first position, thus preventing the butt joint 420 from being scratched or damaged by an accidental collision.

When the user needs to use the butt joint 420 to supply power to the external electronic device, the butt joint 420 is pushed into the cable outlet 100*a*, and the step structure formed by the height difference between the butt joint 420 and the cable body 410 can push the slider 720 to move continuously into the shell assembly 100, such that the free end of the pull rod 740 moves in the sliding groove 721 to be separated from the clamping groove 721*b* and moves to the exiting groove 721*c*; under a restoring force of the elastic member 710, the slider 720 is driven by the elastic member 710 to be reset to push the butt joint 420 to move out of the cable outlet 100*a*, so as to achieve the function of ejecting the butt joint 420 out of the shell assembly 100. When the slider 720 is reset to an initial position, it can be considered that the butt joint 420 moves to the second position, and the user can conveniently pinch the butt joint 420 at this point, pull the cable body 410 out of the shell assembly 100, and then butt the butt joint 420 to the external electronic device, so as to supply power to the external electronic device.

Figure 12:
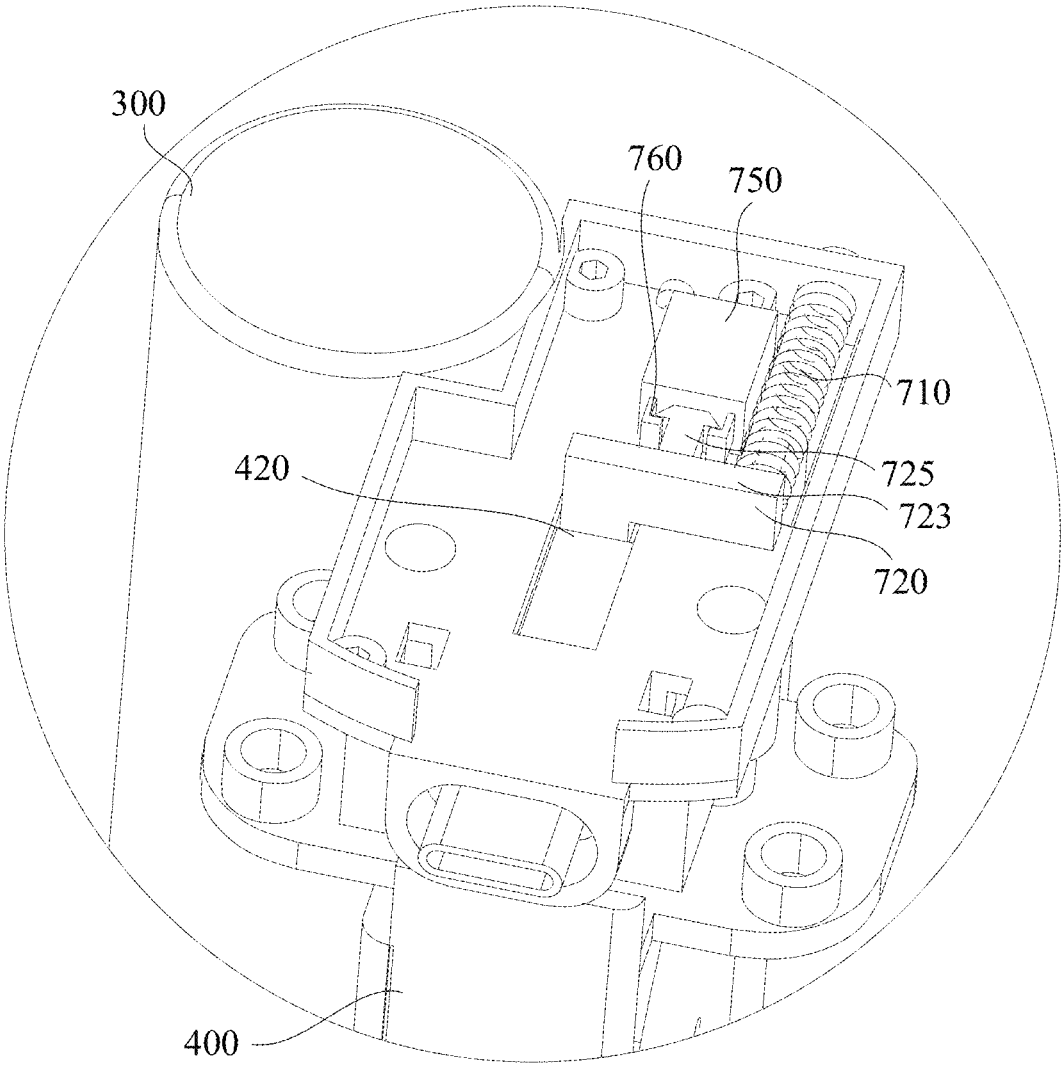
FIG. 12 is a schematic enlarged diagram at B of the portable fan shown in FIG. 6.

Referring to FIG. 12, in some other implementations, the slider 720 has a body 723 and a stop portion 725 which are integrally formed, the elastic member 710 is connected to the body 723, and the ejecting assembly 700 includes a mounting box 750 with a position fixed relative to a position of the shell assembly 100, and a clamping jaw 760 movably arranged on the mounting box 750. In the process that the butt joint 420 is switched from the second position to the first position, the butt joint 420 drives the slider 720 to move in the shell assembly 100, the stop portion 725 is caused to pass over the clamping jaw 760, and the clamping jaw 760 and the stop portion 725 are locked at the first position, thereby positioning the butt joint 420 at the first position. The clamping jaw 760 can be driven to be opened, such that the elastic member 710 can drive the stop portion 725 to be separated from the clamping jaw 760 and drive the slider 720 to drive the butt joint 420 to be ejected out of the shell assembly 100. A spring, or the like, may be arranged inside the mounting box 750, or the clamping jaw 760 may be fitted with the torsion spring 450, or the like, such that the clamping jaw 760 tends to remain closed to reliably keep the stop portion 725 of the slider 720 within the clamping jaw 760 in the first position. The clamping jaw 760 is driven to be opened by an exposed button or a pull cord or another structure, the elastic member 710 pushes the slider 720 to be reset, and then, the slider 720 pushes the butt joint 420 to be ejected out of the shell assembly 100.

Figure 13:
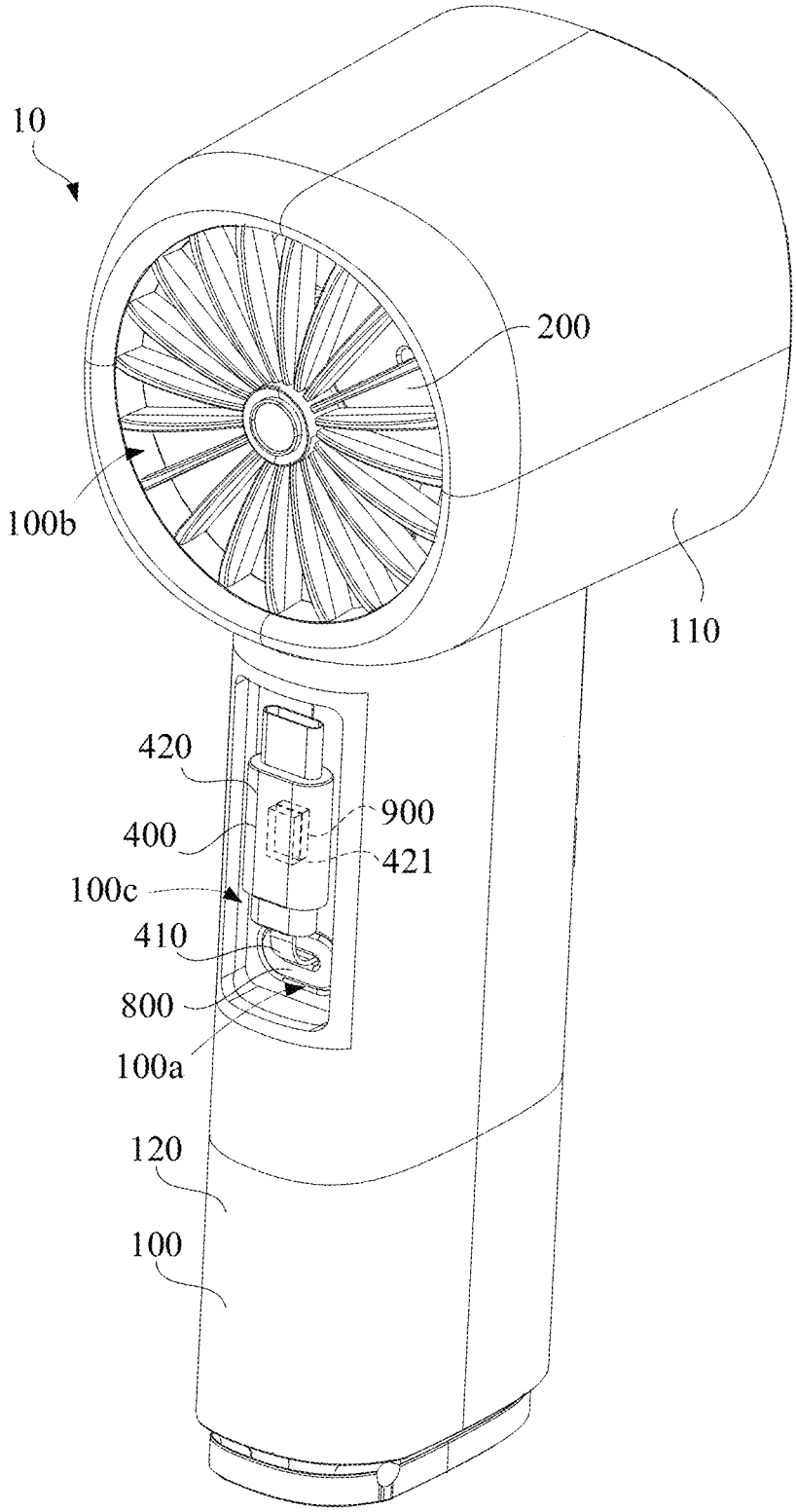
FIG. 13 is a schematic diagram of another implementation of the portable fan according to the first embodiment.

Referring to FIG. 13, in some implementations, the butt joint 420 may be located entirely outside the shell assembly 100 in a state where the butt joint 420 is not used. The portable fan 10 may include a decoration ring 800, the decoration ring 800 penetrates through the cable outlet 100*a* and is limited to the shell assembly 100, the decoration ring 800 has a through hole through which the cable body 410 penetrates, and a width of the through hole is smaller than the width of the butt joint 420. Or, a cross-sectional area of the through hole is smaller than the cross-sectional area of the butt joint 420, and the through hole allows the cable body 410 to freely extend and retract, but restrains the butt joint 420 from being accommodated in the shell assembly 100, and properly seals the cable outlet 100*a*, so as to prevent dust, liquid droplets, or the like, from easily entering the oversized cable outlet 100*a* to achieve a certain waterproof and dustproof effect, and prevent the oversized cable outlet 100*a* from damaging the appearance integrity of the shell assembly 100, that is, improve the appearance integrity of the shell assembly 100.

In this implementation, the decoration ring 800 may be an open ring, a material of the open decoration ring 800 is not limited to hardware (such as stainless steel), silica gel, rubber, or the like, the decoration ring 800 may conveniently sleeve a periphery of the cable body 410, and in the process of assembling the retractable cable module 400 and the shell assembly 100, the butt joint 420 passes through the cable outlet 100*a* from interior the shell assembly 100 to the exterior of the shell assembly 100, and the decoration ring 800 sleeving the cable body 410 may move to the position of the cable outlet 100*a*, and is fixedly riveted, bonded or clamped on the shell assembly 100 at the cable outlet 100*a*, thereby ensuring connection stability between the decoration ring 800 and the shell assembly 100. Certainly, in other implementations, the decoration ring 800 may have a circumferentially closed ring structure, the material thereof may be elastic silica gel, rubber, or the like, the decoration ring 800 is deformed by stretching, and may also conveniently penetrate into the butt joint 420, the decoration ring 800 sleeves the cable body 410, and the decoration ring 800 is limited to the shell assembly 100 at the cable outlet 100*a*.

Further, referring to FIG. 13, in some implementations, the shell assembly 100 has a sunken groove 100*c* communicated with the cable outlet 100*a*, the cable outlet 100*a* is formed in a bottom of the sunken groove 100*c*, and the cable body 410 can be bent to limit the butt joint 420 to the sunken groove 100*c*. For example, the portable fan 10 may include a magnetic member 900, the magnetic member 900 is connected to the shell assembly 100 and arranged corresponding to the bottom of the sunken groove 100*c*, the butt joint 420 has a fitting member 421, and the fitting member 421 is configured to be magnetically fitted with the magnetic member 900 to attach the butt joint 420 to the bottom of the sunken groove 100*c*. Further, one of surfaces of the butt joint 420 in a thickness direction may be attached to the bottom of the sunken groove 100*c*, the surface has a relatively large area, and a depth of the sunken groove 100*c* is not necessarily too large, so as to avoid an excessive influence on the appearance integrity of the shell assembly 100.

One of the magnetic member 900 and the fitting member 421 is a magnet, and the other is a magnet or a ferromagnetic metal member, such as iron, cobalt, nickel and alloys thereof. By means of the magnetic fitting between the magnetic member 900 and the fitting member 421, the butt joint 420 with the bent cable body 410 can be reliably limited in the sunken groove 100*c*, so as to avoid that the butt joint 420 extends out of the shell assembly 100 to adversely affect normal use. Certainly, it may be understood that it is easier to provide the ferromagnetic metal member on the butt joint 420 and provide the magnet on the shell assembly 100. For example, a periphery of the butt joint 420 is covered with the ferromagnetic metal member.

Certainly, ways of limiting the butt joint 420 to the sunken groove 100*c* are not limited to the above way. For example, a groove wall of the sunken groove 100*c* may be provided with a clamping portion for directly clamping and limiting the butt joint 420 to the sunken groove 100*c*. In other words, in this implementation, a side wall of the sunken groove 100*c* or both sides of the butt joint 420 may be provided with a clamping structure that can be deformed by pressing, and in the process of pressing the butt joint 420 into the sunken groove 100*c*, the clamping structure may be deformed, such that the butt joint 420 is clamped in the sunken groove 100*c*. In this way, the butt joint 420 can be reliably limited in the sunken groove 100*c*, and when it is needed, the butt joint 420 can be conveniently taken out of the sunken groove 100*c*, and then, the cable body 410 can be pulled out of the shell assembly 100.

When carrying the above portable fan 10 and having a charging demand, the user can pull the cable body 410 of the retractable cable module 400 out of the shell assembly 100 of the portable fan 10 and butt the butt joint 420 to the external electronic device, such as a mobile phone, so as to supply power to the external electronic device through the power module 300 of the portable fan 10 and achieve a charging function, such that the user does not need to additionally carry a mobile power source and a charging cable, thus improving the use convenience. When the external electronic device does not have a rechargeable battery, the user can also utilize the power module 300 of the portable fan 10 to supply power to the external electronic device. When the user no longer needs to supply power to the external electronic device through the portable fan 10, the cable body 410 of the retractable cable module 400 can be accommodated in the shell assembly 100, and the portable fan 10 can still keep a simple appearance, is convenient for the user to carry, and improves the use convenience. Since the width of the butt joint 420 is not larger than that of the cable outlet 100*a*, the butt joint 420 can extend out of the shell assembly 100 in the process of assembling the retractable cable module 400 and the shell assembly 100, thereby guaranteeing smooth assembly of the retractable cable module 400 and the shell assembly 100.

Second Embodiment

Figure 14:
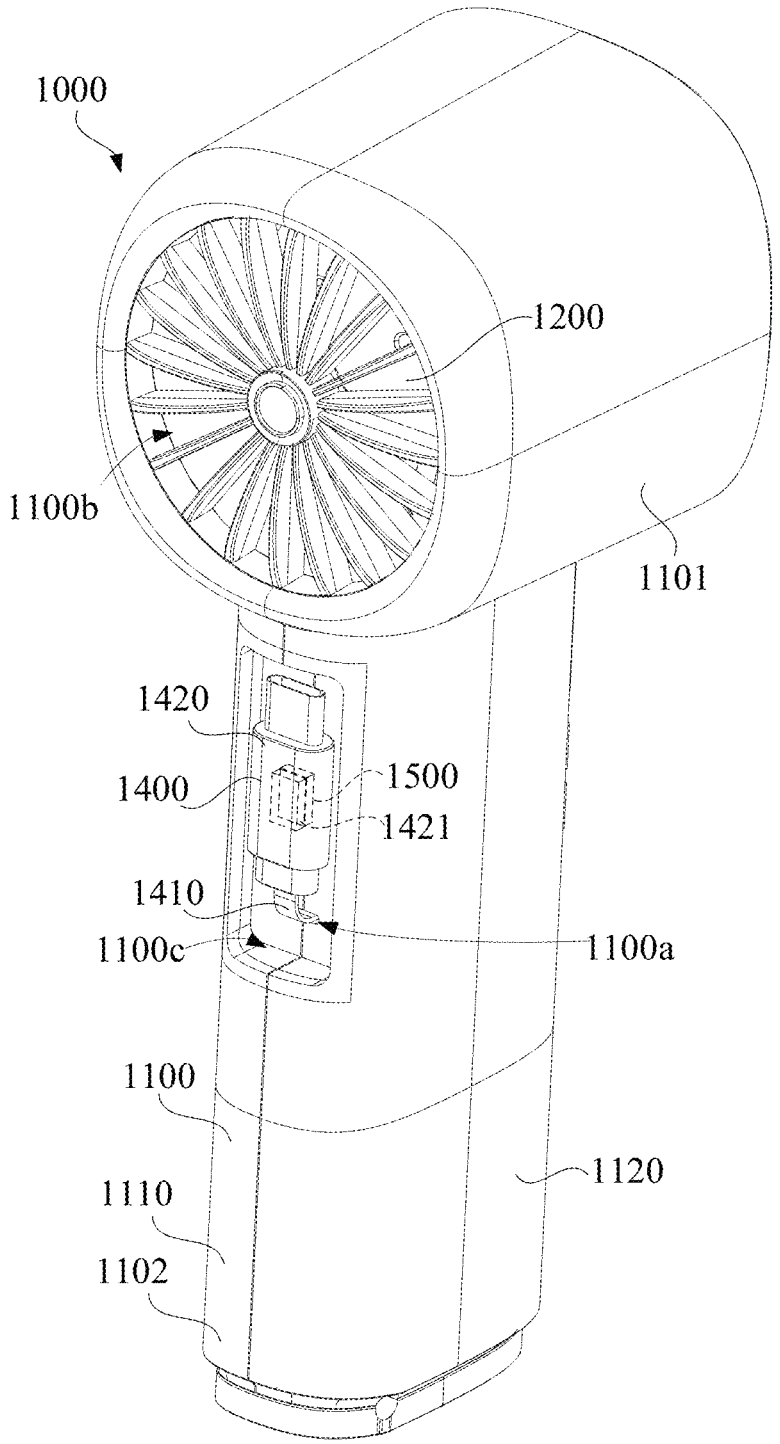
FIG. 14 is a schematic diagram of a portable fan according to a second embodiment.
Figure 15:
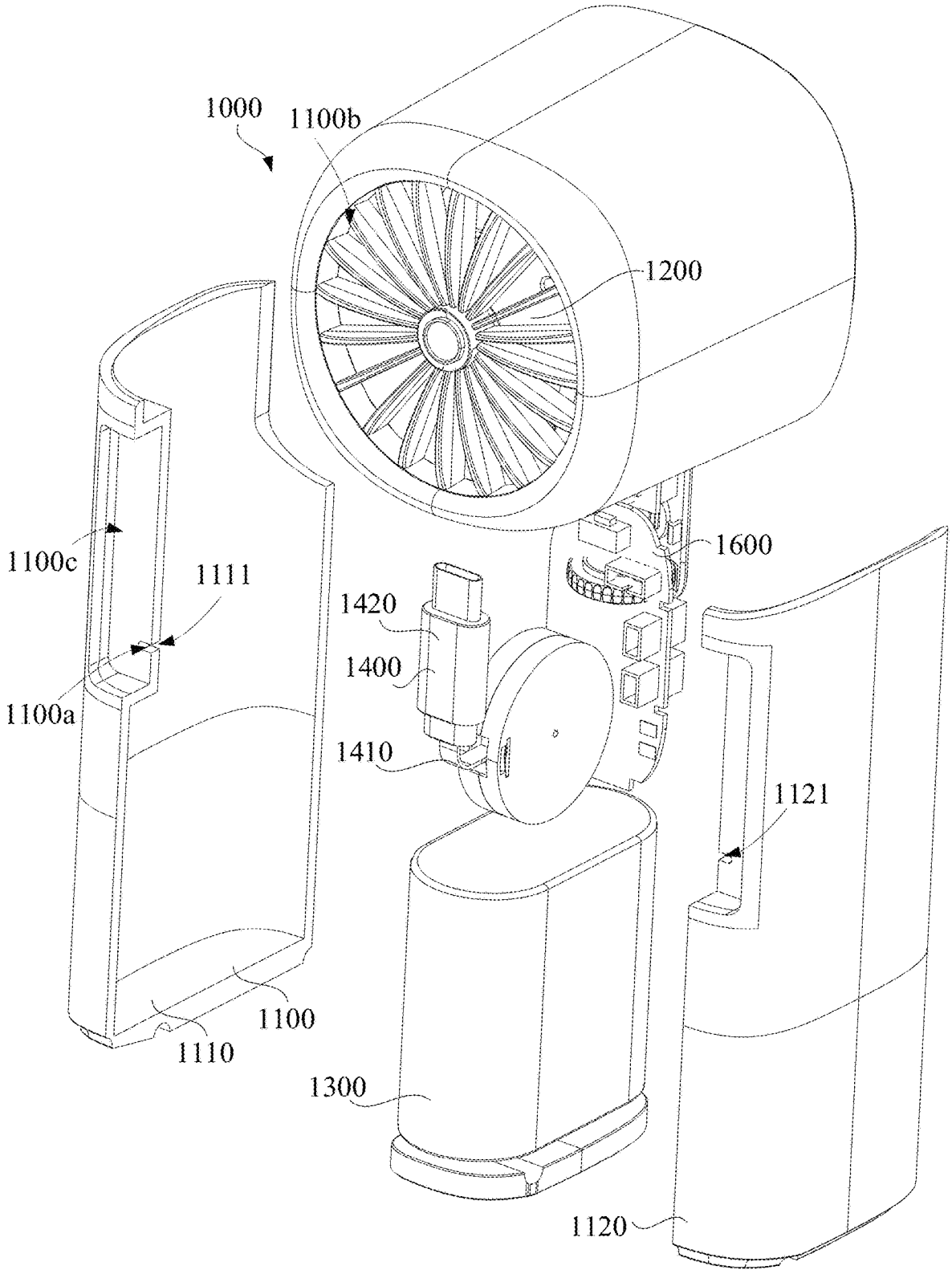
FIG. 15 is an exploded view of the portable fan shown in FIG. 14.

Referring to FIG. 14 and FIG. 15, a second embodiment of the present application provides a portable fan 1000, including a shell assembly 1100, a fan 1200, a power module 1300, and a retractable cable module 1400, wherein the shell assembly 1100 includes a first housing 1110 and a second housing 1120 connected to the first housing 1110, and the first housing 1110 and the second housing 1120 define a cable outlet 1100*a*. The fan 1200 is arranged on the shell assembly 1100, and the shell assembly 1100 is provided with an air outlet 1100*b* for air outgoing of the fan 1200. The power module 1300 is arranged on the shell assembly 1100 and configured to supply power to the fan 1200. The retractable cable module 1400 is arranged on the shell assembly 1100 and includes a cable body 1410 and a butt joint 1420 connected to one end of the cable body 1410, and a width of the butt joint 1420 is greater than a width of the cable outlet 1100*a*. The cable body 1410 is capable of retracting into the cable outlet 1100*a* to be accommodated in the shell assembly 1100, or extending out of the shell assembly 1100 to butt the butt joint 1420 to an external electronic device and supply power to the external electronic device through the power module 1300.

In the second embodiment, the fan 1200 may be an axial fan, a centrifugal fan, or a charging turbine, and is not repeated herein. The portable fan 1000 according to the second embodiment may be a handheld fan, and as shown in FIG. 14, the shell assembly 1100 includes an air outlet portion 1101 and a holding portion 1102 connected to the air outlet portion 1101, the first housing 1110 and the second housing 1120 are configured as a part or the whole of the holding portion 1102, and one of the air outlet portion 1101 and the holding portion 1102 is provided with the cable outlet 1100*a*. The air outlet portion 1101 is provided with the air outlet 1100*b*, the fan 1200 is arranged on the air outlet portion 1101, and the power module 1300 and the retractable cable module 1400 are arranged on the holding portion 1102. Certainly, the fan 1200 may be arranged on the holding portion 1102, and the power module 1300 and the retractable cable module 1400 may also be arranged on the air outlet portion 1101. A user can hold the holding portion 1102 of the portable fan 1000 and allow the air outlet 1100*b* to face some parts of the body, such as the face or the neck, to blow air and dissipate heat.

The portable fan 1000 according to the second embodiment may also include a wearing portion 500 connected to the shell assembly 1100 as in the first embodiment, and the wearing portion 500 is configured to be worn to the body of the user. That is, the portable fan 1000 according to the second embodiment may be a waist fan, a clip fan, or the like. Certainly, the shell assembly 1100 of the portable fan 1000 according to the second embodiment may also be provided with a space for being worn to the body of the user. For example, the shell assembly 1100 is formed into an open ring shape, and the user may wear the portable fan 1000 on the neck. That is, the portable fan 1000 according to the second embodiment may also be a neck fan and is not repeated herein.

The second embodiment is also described by taking a handheld fan as an example, and adaptive variations may be made for other types of portable fans 1000 which should not be excluded from the protection scope of the present application.

The power module 1300 is arranged on the shell assembly 1100 and configured to supply power to the fan 1200, the power module 1300 of the portable fan 1000 generally includes a rechargeable battery, such as a lithium battery, and as a battery technology advances, a capacity of the battery tends to continuously increase, and an endurance performance of the portable fan 1000 is therefore steadily improved. Further, the portable fan 1000 may include a circuit board 1600 arranged in the shell assembly 1100, the fan 1200, the power module 1300, and the cable body 1410 are electrically connected to the circuit board 1600, and the circuit board 1600 may integrate a control circuit, a power management unit, or the like, of the fan 1200. The shell assembly 1100 may further be provided with buttons, a rotating wheel, or the like, which are arranged corresponding to a trigger structure on the circuit board 1600 and configured to control starting and stopping of the fan 1200, or adjust a rotation speed of the fan 1200. The buttons are not limited to physical buttons, and may be virtual buttons, such as virtual keys presented with a touch screen.

In some implementations, the cable body 1410 may be accommodated in the shell assembly 1100 in a wound mode to achieve a hiding effect of the cable body 1410, such that the portable fan 1000 maintains a simple appearance, and inconvenience of the user in normal use caused by the cable body 1410 is avoided. When needing to supply power to the external electronic device, such as a mobile phone, the user may pull the cable body 1410 of the retractable cable module 1400 out of the shell assembly 1100 and butt the cable body 410 to the external electronic device through the butt joint 1420, so as to supply power to the external electronic device, for example, charge the mobile phone, through the power module 1300 of the portable fan 1000. The butt joint 1420 is not limited to a Type-C interface, a Micro-USB interface, a Lightning interface, a magnetic charging interface, or the like, and is not repeated herein.

For the structure and working principle of the retractable cable module 1400 in the second embodiment of the present application, reference may be made to the first embodiment, and when the retractable cable module 1400 according to the first embodiment is applied to the second embodiment, only adaptive variations are required, and details are not repeated herein.

The difference from the first embodiment is that the shell assembly 1100 of the portable fan 1000 according to the second embodiment may include the first housing 1110 and the second housing 1120 which are assembled separately, or the first housing 1110 and the second housing 1120 have parting surfaces, and the two surfaces are assembled and define the cable outlet 1100*a*. The width of the cable outlet 1100*a* may be smaller than the width of the butt joint 1420. For example, a cross-sectional area of the cable outlet 1100*a* is smaller than a cross-sectional area of the butt joint 1420, and the cross-sectional area of the cable outlet 1100*a* may be equal to a cross-sectional area of the cable body 1410, as long as the cable body 1410 can extend out of and retract into the shell assembly 1100. In other words, in this implementation, the width of the cable outlet 1100*a* is not required to be greater than or equal to the width of the butt joint 1420, the cable outlet 1100*a* can be made relatively small, so as to reduce damage to appearance integrity of the shell assembly 1100, and meanwhile lower the probability that dust and liquid droplets enter the shell assembly 1100 from the cable outlet 1100*a*. In this implementation, the first housing 1110 and the second housing 1120 can be assembled in a butt mode, for example, fixedly buckled or clamped or bonded, so as to define the cable outlet 1100*a*. In the process of assembling the retractable cable module 1400 and the shell assembly 1100, the cable body 1410 penetrates through the cable outlet 1100*a*, and the first housing 1110 and the second housing 1120 are assembled in the butt mode, thereby guaranteeing smooth assembly of the retractable cable module 1400 and the shell assembly 1100 and improving an assembly efficiency.

Referring to FIG. 15, in some implementations, the first housing 1110 is provided with a first notch 1111, the second housing 1120 is provided with a second notch 1121, and the first notch 1111 and the second notch 1121 are butted to define the cable outlet 1100*a*. In this implementation, the first notch 1111 and the second notch 1121 may be arranged in mirror symmetry with respect to the parting surface to obtain a harmonious appearance effect on the shell assembly 1100. In other implementations, a length of the first notch 1111 or a distance between a tail end of the first notch 1111 and the parting surface may be greater than a length of the second notch 1121, and even the second notch 1121 may be absent. That is, the cable outlet 1100*a* may be formed by butting a straight edge at the parting surface of the second housing 1120 to the first notch 1111 of the first housing 1110, and the retractable cable module 1400 can be assembled smoothly on the shell assembly 1100.

When carrying the above portable fan 1000 and having a charging demand, the user can pull the cable body 1410 of the retractable cable module 1400 out of the shell assembly 1100 of the portable fan 1000 and butt the butt joint 1420 to the external electronic device, such as a mobile phone, so as to supply power to the external electronic device through the power module 1300 of the portable fan 1000 and achieve a charging function, such that the user does not need to additionally carry a mobile power source and a charging cable, thus improving the use convenience. When the external electronic device does not have a rechargeable battery, the user can also utilize the power module 1300 of the portable fan 1000 to supply power to the external electronic device. When the user no longer needs to supply power to the external electronic device through the portable fan 1000, the cable body 1410 of the retractable cable module 1400 can be accommodated in the shell assembly 1100, and the portable fan 1000 can still keep a simple appearance, is convenient for the user to carry, and improves the use convenience. Since the width of the butt joint 1420 is larger than that of the cable outlet 1100*a*, and the first housing 1110 and the second housing 1120 define the cable outlet 1100*a*, in the process of assembling the retractable cable module 1400 and the shell assembly 1100, the cable body 1410 can penetrate through the cable outlet 1100*a* between the first housing 1110 and the second housing 1120, and then, the first housing 1110 and the second housing 1120 are assembled and fixed, such that smooth assembly of the retractable cable module 1400 and the shell assembly 1100 can be guaranteed.

Certainly, in the second embodiment of the present application, the portable fan 1000 may also include a decoration ring 800 similar to that in the first embodiment, the decoration ring 800 penetrates through the cable outlet 1100*a* and is fixedly connected to the first housing 1110 and the second housing 1120, the decoration ring 800 may be made of a metal material, such as stainless steel, or may be made of a non-metal material, such as rubber or silica gel, and the cable body 1410 penetrates through the decoration ring 800. Under the condition that the width of the cable outlet 1100*a* is smaller than the width of the butt joint 1420, the decoration ring 800 can still play a good decoration role, it is avoided that the appearance integrity of the shell assembly 1100 is damaged by an overlarge width of the cable outlet 1100*a*, a better waterproof and dustproof effect is achieved, and scratching or abrasion caused by direct friction between the cable body 1410 and the first housing 1110 or the second housing 1120 can be reduced by utilizing matching of materials. For example, the decoration ring 800 contains a self-lubricating material or has a smoother surface to reduce the abrasion of the cable body 1410.

Certainly, in the second embodiment, the first housing 1110 and the second housing 1120 may define a sunken groove 1100*c* communicated with the cable outlet, the cable outlet 1100*a* is arranged at a bottom of the sunken groove 1100*c*, and the cable body 1410 can be bent to limit the butt joint 1420 to the sunken groove 1100*c*. For example, the portable fan 1000 may include a magnetic member 1500, the magnetic member 1500 is connected to the shell assembly 1100 and arranged corresponding to the bottom of the sunken groove 1100*c*, the butt joint 1420 has a fitting member 1421, and the fitting member 1421 is configured to be magnetically fitted with the magnetic member 1500 to attach the butt joint 1420 to the bottom of the sunken groove 1100*c*. Further, one of surfaces of the butt joint 1420 in a thickness direction may be attached to the bottom of the sunken groove 1100*c*, the surface has a relatively large area, and a depth of the sunken groove 1100*c* is not necessarily too large, so as to avoid an excessive influence on the appearance integrity of the shell assembly 1100.

One of the magnetic member 1500 and the fitting member 1421 is a magnet, and the other is a magnet or a ferromagnetic metal member, such as iron, cobalt, nickel and alloys thereof. By means of the magnetic fitting between the magnetic member 1500 and the fitting member 1421, the butt joint 1420 with the bent cable body 1410 can be reliably limited in the sunken groove 1100*c*, so as to avoid that the butt joint 1420 drops out of the shell assembly 1100 to adversely affect normal use. Certainly, it may be understood that it is easier to provide the ferromagnetic metal member on the butt joint 1420 and provide the magnet on the shell assembly 1100. For example, a periphery of the butt joint 1420 is covered with the ferromagnetic metal member.

Certainly, ways of limiting the butt joint 1420 to the sunken groove 1100*c* are not limited to the above way. For example, a groove wall of the sunken groove 1100*c* may be provided with a clamping portion for directly clamping and limiting the butt joint 1420 to the sunken groove 1100*c*. In other words, in this implementation, a side wall of the sunken groove 1100*c* or both sides of the butt joint 1420 may be provided with a clamping structure that can be deformed by pressing, and in the process of pressing the butt joint 1420 into the sunken groove 1100*c*, the clamping structure may be deformed, such that the butt joint 1420 is clamped in the sunken groove 1100*c*. In this way, the butt joint 1420 can be reliably limited in the sunken groove 1100*c*, and when it is needed, the butt joint 1420 can be conveniently taken out of the sunken groove 1100*c*, and then, the cable body 1410 can be pulled out of the shell assembly 1100, and reference may be made to the first embodiment for the structure and function of the sunken groove 1100*c* which are not repeated herein.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the specification.

The above-described embodiments are only several implementations of the present invention, and the descriptions are relatively specific and detailed, but they should not be construed as limiting the scope of the present invention. It should be understood by those of ordinary skill in the art that various modifications and improvements can be made without departing from the concept of the present invention, and all fall within the protection scope of the present invention. Therefore, the protection scope of the present invention should be subject to the appended claims.

The invention claimed is:

1. A portable fan, comprising:

a shell assembly provided with a cable outlet;

a fan arranged on the shell assembly, the shell assembly being provided with an air outlet for air outgoing of the fan;

a power module arranged on the shell assembly and configured to supply power to the fan; and a retractable cable module arranged on the shell assembly and comprising a cable body and a butt joint connected to one end of the cable body, wherein the butt joint is configured to butt to an external electronic device; a width of the butt joint being not larger than that of the cable outlet, and a cross-sectional area of the butt joint is not greater than a cross-sectional area of the cable outlet, such that the butt joint is capable of passing from an interior of the shell assembly to an exterior of the shell assembly through the cable outlet in an assembly process; the cable body is capable of retracting into the cable outlet to be accommodated in the shell assembly, the cable body is also capable of being pulled out of the shell assembly to butt the butt joint to the external electronic device and supply power to the external electronic device through the power module;

wherein the butt joint has a first position and a second position relative to the shell assembly, and in the first position, the cable body is accommodated in the shell assembly and the butt joint is at least partially accommodated in the cable outlet; in the second position, the cable body and the butt joint extend out of the shell assembly for butting to the external electronic device;

wherein the portable fan comprises an ejecting assembly arranged on the shell assembly, and the ejecting assembly is configured to be triggered to eject the butt joint in the first position out of the shell assembly through the cable outlet;

wherein the ejecting assembly comprises an elastic member arranged in the shell assembly and a slider connected to the elastic member, and in the process that the butt joint is switched from the second position to the first position, the slider is driven by the butt joint to move inside the shell assembly and locked in the first position, and the elastic member accumulates elastic potential energy; the slider is configured to be triggered to be unlocked from the shell assembly, and the elastic member drives the slider to drive the butt joint to be ejected out of the shell assembly.

2. The portable fan according to claim 1, wherein the ejecting assembly comprises a mounting base connected to the shell assembly and a pull rod having one end rotatably connected to the mounting base, the slider is in sliding fit to the mounting base, and the elastic member has one end connected to the mounting base and the other end connected to the slider; the other end of the pull rod is in sliding fit with the slider; in the process that the butt joint is pressed into the cable outlet and moves to the first position, the butt joint drives the slider to move relative to the mounting base to clamp the pull rod to the slider at the first position; when the pull rod is clamped to the slider, the butt joint is pushed inwards along the cable outlet, the pull rod can be unlocked from the slider, and the elastic member pushes the butt joint to be ejected from the cable outlet through the slider.

3. The portable fan according to claim 2, wherein the slider is provided with a sliding groove, the sliding groove comprises an entering groove, a clamping groove and an exiting groove, the clamping groove is communicated with the entering groove and the exiting groove, and the exiting groove is communicated with the entering groove; a bottom wall of the entering groove is provided with a plurality of steps, such that a depth of the entering groove is increased from an entrance of the entering groove to a position of the clamping groove; a depth of the exiting groove is smaller than a depth of the clamping groove, and a bottom wall of the exiting groove is in smooth transition with a bottom wall of the clamping groove; the butt joint is pushed inwards along the cable outlet, a free end of the pull rod slides into the entering groove from the entrance of the entering groove, and slides along an extending direction of the entering groove into the clamping groove, and the pull rod is clamped to the slider in the clamping groove, such that the slider is locked on the mounting base, and the butt joint reaches the first position; when the pull rod is clamped to the slider, the butt joint is pushed inwards along the cable outlet, the pull rod slides into the exiting groove and slides along an extending direction of the exiting groove towards the entrance of the entering groove, and the elastic member pushes the butt joint to be ejected from the cable outlet through the slider.

4. The portable fan according to claim 1, wherein the slider has a body and a stop portion which are integrally formed, the elastic member is connected to the body, and the ejecting assembly comprises a mounting box with a position fixed relative to a position of the shell assembly, and a clamping jaw movably arranged on the mounting box; in the process that the butt joint is switched from the second position to the first position, the butt joint drives the slider to move in the shell assembly, the stop portion is caused to pass over the clamping jaw, and the clamping jaw and the stop portion are locked at the first position; the clamping jaw can be driven to be opened, such that the elastic member can drive the stop portion to be separated from the clamping jaw and drive the slider to drive the butt joint to be ejected out of the shell assembly.

5. The portable fan according to claim 1, wherein the portable fan comprises a ring, the ring penetrates through the cable outlet and is limited to the shell assembly, the ring has a through hole through which the cable body penetrates, and a width of the through hole is smaller than the width of the butt joint.

6. The portable fan according to claim 5, wherein the ring is an open ring.

7. The portable fan according to claim 1, wherein the shell assembly has a sunken groove communicated with the cable outlet, the cable outlet is formed in a bottom of the sunken groove, and the cable body can be bent to limit the butt joint to the sunken groove.

8. The portable fan according to claim 7, wherein the portable fan comprises a magnetic member, the magnetic member is connected to the shell assembly and arranged corresponding to the bottom of the sunken groove, the butt joint has a fitting member, and the fitting member is configured to be magnetically fitted with the magnetic member to attach the butt joint to the bottom of the sunken groove.

9. The portable fan according to claim 7, wherein a groove wall of the sunken groove is provided with a clamping portion for clamping and limiting the butt joint to the sunken groove.

10. The portable fan according to claim 1, wherein the portable fan comprises a circuit board arranged in the shell assembly, the retractable cable module comprises a casing arranged in the shell assembly, the fan, the power module, and the cable body are electrically connected with the circuit board, positions of the casing and the circuit board are fixed relatively, and the cable body is telescopically arranged in the casing.

11. The portable fan according to claim 10, wherein the portable fan comprises a limiting member movably fitted to the shell assembly or the casing, the limiting member has an unlocking position and a locking position, and in the unlocking position, the cable body can be pulled out of or retracted into the casing; in the locking position, the limiting member limits movement of the cable body relative to the shell assembly.

12. The portable fan according to claim 1, wherein the shell assembly comprises an air outlet portion and a holding portion connected to the air outlet portion, the air outlet portion is provided with the air outlet, the fan is arranged on the air outlet portion, the power module and the retractable cable module are arranged on the holding portion, and one of the air outlet portion and the holding portion is provided with the cable outlet.

13. The portable fan according to claim 1, wherein the portable fan comprises a wearing portion connected to the shell assembly, and the wearing portion is configured to be worn to the body of a user.

14. The portable fan according to claim 1, wherein the shell assembly is provided with a space for being worn to the body of the user.

* * * * *